US008622659B2

(12) United States Patent
Friederichs et al.

(10) Patent No.: US 8,622,659 B2
(45) Date of Patent: Jan. 7, 2014

(54) RETAINING WALL BLOCK SYSTEM

(75) Inventors: Joseph M. Friederichs, Lakeville, MN (US); Craig D. Moritz, Vadnais Heights, MN (US)

(73) Assignee: Keystone Retaining Wall Systems LLC, West Chester, OH (US)

( * ) Notice: Subject to any disclaimer, the term of this patent is extended or adjusted under 35 U.S.C. 154(b) by 250 days.

(21) Appl. No.: 13/039,924

(22) Filed: Mar. 3, 2011

(65) Prior Publication Data

US 2011/0243669 A1 Oct. 6, 2011

Related U.S. Application Data

(60) Provisional application No. 61/310,466, filed on Mar. 4, 2010.

(51) Int. Cl.
*E02D 29/02* (2006.01)

(52) U.S. Cl.
USPC ..... 405/262; 405/286; 405/284

(58) Field of Classification Search
USPC ..... 405/262, 284, 286
See application file for complete search history.

(56) References Cited

U.S. PATENT DOCUMENTS

| | | | |
|---|---|---|---|
| 4,914,876 | A | 4/1990 | Forsberg |
| 4,920,712 | A | 5/1990 | Dean, Jr. |
| 5,044,834 | A | 9/1991 | Janopaul, Jr. |
| RE34,314 | E | 7/1993 | Forsberg |
| 5,267,816 | A | 12/1993 | Mercer et al. |
| 5,294,216 | A | 3/1994 | Sievert |
| 5,417,523 | A | 5/1995 | Scales |
| 5,511,910 | A | 4/1996 | Scales |
| 5,560,172 | A | 10/1996 | Brophy et al. |
| 5,568,994 | A | 10/1996 | Dawson |
| 5,601,384 | A | 2/1997 | Dawson |
| D380,560 | S | 7/1997 | Forsberg |
| D381,086 | S | 7/1997 | Forsberg |
| 5,642,592 | A | 7/1997 | Andres |

(Continued)

FOREIGN PATENT DOCUMENTS

| | | | |
|---|---|---|---|
| DE | 41 03 330 | A1 | 9/1991 |
| GB | 2 313 867 | A | 12/1997 |

(Continued)

OTHER PUBLICATIONS

US 6,089,793 07/2000, Rainey (withdrawn).

(Continued)

*Primary Examiner* — Frederick L Lagman
(74) *Attorney, Agent, or Firm* — Popovich, Wiles & O'Connell, P.A.

(57) ABSTRACT

A wall block having a block body having opposed front and back faces, opposed first and second side walls, and opposed and substantially parallel top and bottom faces, the top face having a receiving channel, and the receiving channel opening onto one or more pin holes. The wall block can be used in a retaining wall made of (i) a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes; (ii) a soil retaining material; and (iii) a channel bar.

21 Claims, 27 Drawing Sheets

(56) References Cited

U.S. PATENT DOCUMENTS

| | | | | |
|---|---|---|---|---|
| D384,168 | S | 9/1997 | Stevenson | |
| D387,434 | S | 12/1997 | Dawson | |
| D397,230 | S | 8/1998 | Forsberg | |
| 5,788,420 | A | 8/1998 | Scales | |
| D397,808 | S | 9/1998 | Dawson | |
| 5,865,006 | A | 2/1999 | Dawson | |
| 5,911,539 | A | 6/1999 | Egan et al. | |
| 5,913,790 | A | 6/1999 | Dawson | |
| 5,951,210 | A | 9/1999 | Maguire et al. | |
| 6,019,550 | A | 2/2000 | Wrigley et al. | |
| D430,308 | S | 8/2000 | Dawson | |
| 6,149,352 | A | 11/2000 | MacDonald | |
| D435,304 | S | 12/2000 | Rainey | |
| 6,168,351 | B1 | 1/2001 | Rainey | |
| 6,318,934 | B1 * | 11/2001 | Borgersen et al. | 405/262 |
| 6,322,291 | B1 * | 11/2001 | Rainey | 405/262 |
| 6,338,597 | B1 * | 1/2002 | Rainey | 405/262 |
| 6,416,257 | B1 * | 7/2002 | Rainey | 405/262 |
| 6,443,663 | B1 * | 9/2002 | Scales et al. | 405/262 |
| 6,447,211 | B1 * | 9/2002 | Scales et al. | 405/262 |
| 6,457,911 | B1 * | 10/2002 | Scales et al. | 405/262 |
| 6,536,994 | B2 | 3/2003 | Race | |
| 6,612,784 | B2 * | 9/2003 | Rainey et al. | 405/284 |
| 6,615,561 | B2 | 9/2003 | MacDonald et al. | |
| 6,709,201 | B2 | 3/2004 | Race | |
| D488,242 | S | 4/2004 | MacDonald | |
| D488,568 | S | 4/2004 | MacDonald | |
| D488,569 | S | 4/2004 | Dawson | |
| D490,542 | S | 5/2004 | MacDonald | |
| 6,758,636 | B2 * | 7/2004 | Rainey et al. | 405/262 |
| 6,803,002 | B2 | 10/2004 | Suto et al. | |
| 6,821,058 | B1 | 11/2004 | Dawson | |
| 6,827,527 | B2 * | 12/2004 | Conkel et al. | 405/284 |
| D501,935 | S | 2/2005 | Dawson et al. | |
| 6,854,231 | B2 | 2/2005 | MacDonald et al. | |
| 6,912,823 | B2 | 7/2005 | MacDonald et al. | |
| 6,921,231 | B2 * | 7/2005 | Rainey et al. | 405/262 |
| 7,168,892 | B1 | 1/2007 | MacDonald et al. | |
| 7,448,830 | B2 | 11/2008 | MacDonald et al. | |
| 7,641,178 | B2 | 1/2010 | MacDonald et al. | |
| D610,710 | S | 2/2010 | LaCroix et al. | |
| 7,654,776 | B2 | 2/2010 | MacDonald et al. | |
| D620,615 | S | 7/2010 | MacDonald et al. | |
| D621,070 | S | 8/2010 | MacDonald et al. | |
| 7,780,141 | B2 | 8/2010 | Dawson et al. | |
| 7,934,351 | B2 | 5/2011 | Clarno | |
| 7,971,407 | B2 | 7/2011 | MacDonald | |
| 2005/0016106 | A1 | 1/2005 | Dawson et al. | |
| 2006/0110223 | A1 | 5/2006 | Dawson | |
| 2008/0277561 | A1 | 11/2008 | MacDonald | |
| 2008/0289282 | A1 | 11/2008 | MacDonald | |
| 2008/0302350 | A1 | 12/2008 | LaCroix | |
| 2008/0307740 | A1 | 12/2008 | MacDonald | |
| 2008/0313988 | A1 | 12/2008 | MacDonald | |
| 2009/0120029 | A1 | 5/2009 | LaCroix et al. | |
| 2009/0151281 | A1 | 6/2009 | MacDonald et al. | |
| 2009/0188196 | A1 | 7/2009 | MacDonald | |
| 2009/0308015 | A1 | 12/2009 | MacDonald et al. | |
| 2009/0313936 | A1 | 12/2009 | MacDonald et al. | |
| 2010/0308502 | A1 | 12/2010 | LaCroix et al. | |
| 2010/0310695 | A1 | 12/2010 | LaCroix et al. | |
| 2011/0072753 | A1 | 3/2011 | MacDonald | |
| 2011/0217127 | A1 | 9/2011 | MacDonald | |

FOREIGN PATENT DOCUMENTS

| | | | |
|---|---|---|---|
| WO | WO 95/33893 | A1 | 12/1995 |
| WO | WO 97/44533 | A1 | 11/1997 |
| WO | WO 00/22243 | A1 | 4/2000 |
| WO | WO 2005/035902 | A1 | 4/2005 |
| WO | WO 2011/109621 | A1 | 9/2011 |

OTHER PUBLICATIONS

Anchor Landmark System product brochure © 2001 (4 pages).
Aug. 10, 2011 PCT International Search Report for Application No. PCT/US2011/027031 (5 pages).
Abstract for DE 41 03 330 Al (1 page).

* cited by examiner

RETAINING WALL BLOCK SYSTEM

This application claims the benefit of U.S. Provisional Patent Application No. 61/310,466, filed Mar. 4, 2010, entitled "Retaining Wall Block System", the contents of which are hereby incorporated by reference herein.

FIELD OF THE INVENTION

The present invention relates to retaining wall blocks and walls made from such blocks. In particular, this invention relates to retaining wall blocks having a pinning system and channel bar that can be used with soil reinforcement material, such as a geogrid and walls made therefrom.

BACKGROUND OF THE INVENTION

Numerous methods and materials exist for the construction of retaining walls. Such methods include the use of natural stone, poured in-place concrete, pre-cast concrete, masonry, and landscape timbers or railroad ties. In recent years, segmental concrete retaining wall units which are dry stacked (i.e., built without the use of mortar) have become a widely accepted product for the construction of retaining walls. Examples of such products are described in U.S. Pat. No. Re. 34,314 (Forsberg '314) and U.S. Pat. No. 5,294,216 (Sievert). Such products have gained popularity because they are mass produced, and thus relatively inexpensive. They are structurally sound, easy and relatively inexpensive to install, and couple the durability of concrete with the attractiveness of various architectural finishes.

The retaining wall system described in Forsberg '314 has been particularly successful because of its use of block design that includes, among other design elements, a unique pinning system that interlocks and aligns the retaining wall units, allowing structural strength and efficient rates of installation. This system has also shown considerable advantages in the construction of larger walls when combined with the use of geogrid tie-backs hooked over the pins, as described in U.S. Pat. No. 4,914,876 (Forsberg).

The construction of modular concrete retaining walls as described in Forsberg involves several relatively simple steps. First, a leveling pad of dense base material or unreinforced concrete is placed, compacted and leveled. Second, the initial course of blocks is placed and leveled. Two pins are placed in each block into the pin holes. Third, core fill material, such as crushed rock, is placed in the cores of the blocks and spaces between the blocks to encourage drainage and add mass to the wall structure. Fourth, succeeding courses of the blocks are placed in a "running bond" pattern such that each block is placed between the two blocks below it. This is done by placing the blocks so that the receiving cavities of the bottom of the block fit over the pins that have been placed in the units in the course below. As each course is placed, pins are placed in the blocks, the blocks are corefilled with drainage rock, and the area behind the course is backfilled and compacted until the wall reaches the desired height.

Many retaining wall systems described in the art include the use of reinforcing materials, also referred to as geogrids, geosynthetic reinforcement, or geogrid soil reinforcement. These terms sometimes are used interchangeably, and "geogrid" as used herein is intended as a generic term. Reinforcement materials may be inextensible, such as steel mesh, or extensible geosynthetic materials, such as mats and oriented polymeric materials. For example, flat polymeric sheets are used to form geogrids by forming holes in the sheets and then drawing them to orient the polymer and increase the modulus.

Such polymeric materials include high density polyethylene (HDPE) and these materials form relatively stiff geogrids commercially available under the trade designation "TENSAR".

While the HDPE materials are relatively stiff, a second type of geosynthetic material is composed of a mat typically formed from polyester fibers that are woven or knitted. These may comprise rectilinear polymer constructions characterized by large (e.g., 1 inch (2.5 cm) or greater) openings. In these open structure geogrids, polymeric strands are woven, knitted or "welded" (by means of adhesives and/or heat) together in a grid. Polymers used for making relatively flexible geogrids include polyester fibers. The polyester typically is coated, commonly using a polyvinyl chloride (PVC) or a latex topcoat. The coating may contain carbon black for ultraviolet (UV) stabilization. Some open structure geogrids comprise polyester yarn for the warp fibers and polypropylene as the fill fibers.

Another flexible reinforcing geosynthetic material is geotextile fabric, i.e., woven or non-woven constructions without large openings. These fabrics typically comprise polymers and may be referred to as geofabrics. The geofabric can be laid between courses of blocks in a wall, and typically is tied into the wall and held there. When blocks are configured to have pin connectors, for example, a hole or slit is formed in the geofabric at the construction site and the geofabric is held on the blocks by fitting it over the pins.

In common use, the geogrid extends behind the retaining wall and ties into the earth behind the wall, thus creating a cohesive soil mass tied into the wall facing that resists overturning. Geogrids are either mechanically connected to a course of blocks or rely on the friction created by placing the geogrid layer between courses of blocks. When the mode of connection is friction alone, the geogrid is placed on top of a course of blocks, and then a succeeding layer of blocks is placed on top of the geogrid. When the connection is mechanical, after placement of a course of blocks to the desired height, geogrid is placed onto a course of blocks and held in place by means of pins in the block (which may have a primary function of aligning and holding blocks together) or by means of special connectors. Flexible geogrid is put under tension by pulling back and staking the geogrid behind the retaining wall. Backfill is placed and compacted over the geogrid. Construction of the wall continues and may include additional layers of geogrid.

Such systems have proven reliable in many wall applications. There are limits to their performance however, particularly at the upper portions of the wall, where the load of the blocks above the geogrids layer do not provide as much load on the connection, so that frictional forces are reduced. The use of frictional connections forces the wall designer and builder to use more and higher strength geogrids because connection strength limits the strength of the system, and this adds expense to the wall. Mechanical connectors and retaining mechanisms attempt to overcome this limitation by mechanically connecting the geogrids to the wall facing in a way that is not load dependent. The difficulty with this approach is that in order for such connectors and retaining mechanisms to provide high levels of efficient connection they must add considerable expense to the cost of using the geogrids reinforcement, and add complexity and expense to the installation process. Thus there are shortcomings to both approaches.

However, it is desirable to facilitate construction methods of retaining walls as well as to optimize the ease of construction and durability of the wall being built.

It would be desirable to produce a wall block and a wall from the wall block having a pinning system for interlocking blocks.

It would further be desirable for the pinning system to be used with soil reinforcement materials, such as a geogrid.

It would also be desirable to produce a wall block having a pinning system for interlocking blocks and a channel with a channel bar that could be used in combination with soil reinforcement materials, such as a geogrid that would secure the soil reinforcement material to the block.

It would also be desirable to produce a retaining wall from a wall block having a pinning system for interlocking blocks and a channel with a channel bar that could be used in combination with soil reinforcement materials, such as a geogrid, to secure the soil reinforcement material to the block and thus the wall itself to allow for greater stability and durability of the retaining wall.

It would be further desirable to produce a retaining wall from a wall block with a channel bar system that interconnects courses of block with pins.

It would further be desirable to produce a wall, such as a retaining wall, from a wall block with a pinning system and/or a channel bar system that allows for the creation of curved, circular and serpentine shaped walls.

SUMMARY OF THE INVENTION

The invention provides a wall block comprising a block body having opposed front and back faces, opposed first and second side walls, and opposed and substantially parallel top and bottom faces, the top face having a receiving channel, and the receiving channel opening onto one or more pin holes.

The invention provides a channel bar for use in engaging a soil retaining material used for stabilizing a wall formed from a plurality of wall blocks, each block having a top surface having a receiving channel, the channel bar comprising: an elongate bar configured to engage the soil retaining material within the receiving channel, the elongate bar being generally rectangular and having a top surface, a bottom surface, front surface, back surface, and first and second side surfaces, the top and bottom surfaces being substantially parallel, the first and second side surfaces being substantially parallel, and the front surface having a compound angular shape, and the elongate bar having at least one pin receiving slot that receives pins.

The invention provides a channel bar for use in engaging a soil retaining material used for stabilizing a wall formed from a plurality of wall blocks, each block having a top surface having a receiving channel, the channel bar comprising: an elongate bar configured to engage the soil retaining material within the receiving channel, the elongate bar having a generally rectangular base portion having a top surface, a bottom surface, front surface, back surface, and first and second side surfaces, the top and bottom surfaces being substantially parallel, the first and second side surfaces being substantially parallel, the front and back surfaces being substantially parallel, and the bottom surface having at least one channel bar pin extending from the bottom surface.

The invention provides a retaining wall comprising: a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes; a soil retaining material; and a channel bar comprising an elongate bar configured to engage the soil retaining material within the receiving channel, the elongate bar being generally rectangular and having a top surface, a bottom surface, front surface, back surface, and first and second side surfaces, the top and bottom surfaces being substantially parallel, the first and second side surfaces being substantially parallel, and the elongate bar having at least one pin receiving slot that receives pins.

The invention provides a retaining wall comprising: a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes; a soil retaining material; and a channel bar comprising an elongate bar configured to engage the soil retaining material within the receiving channel, the elongate bar having a generally rectangular base portion having a top surface, a bottom surface, front surface, back surface, and first and second side surfaces, the top and bottom surfaces being substantially parallel, the first and second side surfaces being substantially parallel, the front and back surfaces being substantially parallel, and the bottom surface having at least one channel bar pin extending from the bottom surface.

The present invention relates to a method of constructing a retaining wall with a pinning system that interlocks courses of blocks in a wall and a channel bar system that that secures soil reinforcement materials, such as geogrid, to the blocks in a course of the retaining wall. A block is provided with pin holes and pin receiving cavities, the pin holes of a block in a lower course of the wall receive a shaft or base of a pin and the pin receiving cavities of a block in an upper course of the wall receive the head or top of the pin thereby interlocking the blocks in the upper and lower course. The block is also provided with a receiving channel on a surface of a block that has pin holes and receives the pins of the pinning system. A layer of soil reinforcement material is laid over the pins and receiving channel and then a channel bar with pin receiving slots is placed over the pins and soil reinforcement material and into the receiving channel. The soil reinforcement material is then folded back over the channel bar and pins and extends back towards the retained earth of the wall. The channel bar is manufactured in a manner that allows the channel bar to pivot in the receiving channel as the soil reinforcing material is pulled back towards the retained earth of the wall securing the soil reinforcing material to the retaining wall. The next course of block is placed on the lower course with the head or top of the pins being received in the pin receiving cavities of the upper course providing additional securing of the soil reinforcement material to the retaining wall. The invention also relates to the blocks and channel bar and additionally to methods of constructing walls with the blocks, walls with the blocks and channel bar system and walls with the blocks and pinning system. Multiple embodiments of the block and channel bar are disclosed.

It is to be understood that both the foregoing general description and the following detailed description are exemplary and explanatory and are intended to provide further explanation of the invention as claimed.

BRIEF DESCRIPTION OF THE DRAWINGS

A preferred form of the present invention will now be described by way of example with reference to the accompanying drawings.

DETAILED DESCRIPTION OF THE PREFERRED EMBODIMENTS

Figure 1:
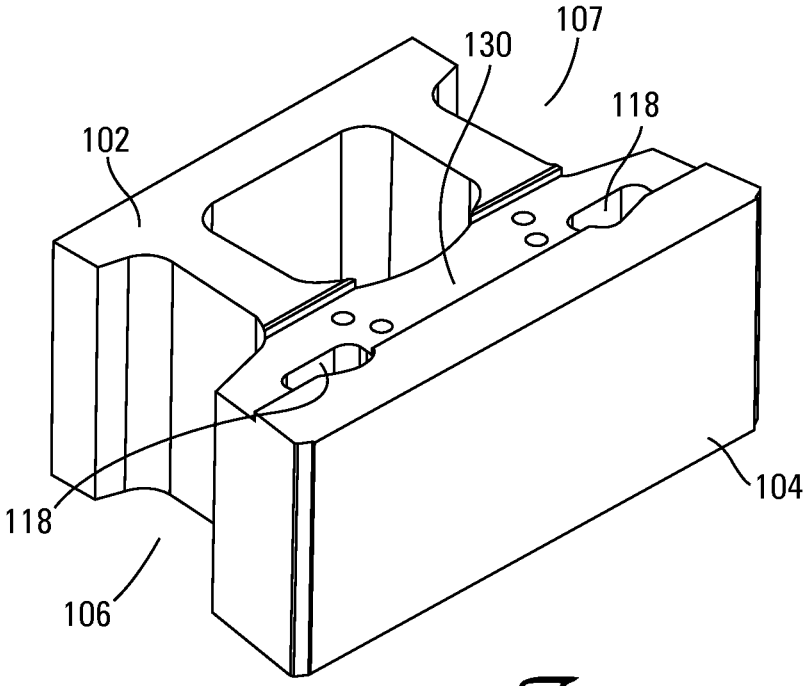
FIGS. 1 to 4 are top perspective, side, top and bottom views, respectively, of an embodiment of a wall block of the present invention.
Figure 2:
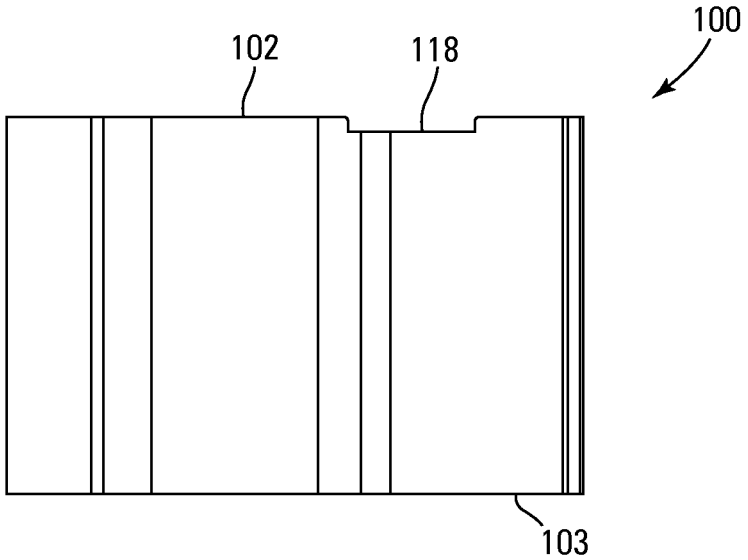

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of this by positioning the lower surface of one block on the upper surface of another block.

The blocks of this invention are described and shown as being symmetrical about a vertical plane of symmetry. However, the features of this invention may also be incorporated into blocks that are asymmetrical. The blocks are provided with pin holes, pin receiving cavities, and at least one core which serve to decrease the weight of the block while maintaining its strength while also providing ease of construction of a retaining wall. The blocks are also provided with one or more receiving channels. The location, shape, and size of the pin holes, pin receiving cavities and receiving channels are selected to maximize the strength of the block, as described by reference to the drawings. It is also to be understood that the pin holes, pin receiving cavities and receiving channels in addition to pins and channel bars described below could also be used on different block types and block shapes to form different walls and that the blocks shown with these features does not limit the scope of the invention.

The invention provides a wall block comprising a block body having opposed front and back faces, opposed first and second side walls, and opposed and substantially parallel top and bottom faces, the top face having a receiving channel, and the receiving channel opening onto one or more pin holes. In one embodiment, the front face is substantially parallel to the back face. In one embodiment, the receiving channel is substantially parallel to the front face. In an embodiment, the receiving channel is substantially perpendicular to a vertical plane of symmetry. In an embodiment, the receiving channel is closer to the front face than the back face. In an embodiment, wherein the receiving channel extends from the first side wall to the second side wall and opens onto the first and second side walls. In another embodiment, the receiving channel does not extend from the first side wall to the second side wall and does not open onto the first or second side walls.

In an embodiment, the receiving channel opens onto at least one pair of pin holes. In one embodiment, the receiving channel opens onto one pair of pin holes. In another embodiment, the receiving channel opens onto two pairs of pin holes.

In an embodiment, the receiving channel opens onto a pair of pin receiving cavities. In one embodiment, the pin receiving cavities have tops and the tops of the pin receiving cavities open onto only the receiving channel. In an embodiment, the pin receiving cavities have tops and the tops of the pin receiving cavities open onto the receiving channel and the top face. In an embodiment, the front face and the back face both have lengths and the length of the front face is greater than the length of the back face. In one embodiment, at least a portion of the side walls are angled back from the front face to the back face such that the portion of each side wall forms an acute angle with the front face.

In one embodiment, the receiving channel has a depth of from 0.25 to 1.5 inches (6.4 to 38 mm) In an embodiment, the bottom face comprises a second receiving channel that can accept pins. In another embodiment, the block comprises a core.

The invention provides a channel bar for use in engaging a soil retaining material used for stabilizing a wall formed from a plurality of wall blocks, each block having a top surface having a receiving channel, the channel bar comprising: an elongate bar configured to engage the soil retaining material within the receiving channel, the elongate bar being generally rectangular and having a top surface, a bottom surface, front surface, back surface, and first and second side surfaces, the top and bottom surfaces being substantially parallel, the first and second side surfaces being substantially parallel, and the front surface having a compound angular shape, and the elongate bar having at least one pin receiving slot that receives pins. In one embodiment, the elongate bar has at least two pin receiving slots that receive pins. In an embodiment, the back surface has a curved shape.

The invention provides a channel bar for use in engaging a soil retaining material used for stabilizing a wall formed from a plurality of wall blocks, each block having a top surface having a receiving channel, the channel bar comprising: an elongate bar configured to engage the soil retaining material within the receiving channel, the elongate bar having a generally rectangular base portion having a top surface, a bottom surface, front surface, back surface, and first and second side surfaces, the top and bottom surfaces being substantially parallel, the first and second side surfaces being substantially parallel, the front and back surfaces being substantially parallel, and the bottom surface having at least one channel bar pin extending from the bottom surface. In an embodiment, the bottom surface has at least two channel bar pins extending from the bottom surface. In one embodiment, the top surface has at least one channel bar pin extending from the top surface. In an embodiment, the top surface has at least two channel bar pins extending from the top surface. In an embodiment, the at least one channel bar pin comprises friction fins.

The invention provides a retaining wall comprising: a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes; a soil retaining material; and a channel bar comprising an elongate bar configured to engage the soil retaining material within the receiving channel, the elongate bar being generally rectangular and having a top surface, a bottom surface, front surface, back surface, and first and second side surfaces, the top and bottom surfaces being substantially parallel, the first and second side surfaces being substantially parallel, and the elongate bar having at least one pin receiving slot that receives pins. In one embodiment, the front face of the at least one block is substantially parallel to the back face. In an embodiment, the receiving channel of the at least one block is substantially parallel to the front face. In an embodiment, the receiving channel of the at least one block is substantially perpendicular to a vertical plane of symmetry. In an embodiment, the receiving channel of the at least one block is closer to the front face than the back face. In one embodiment, the receiving channel of the at least one block extends from the first side wall to the second side wall and opens onto the first and second side walls. In an embodiment, the receiving channel of the at least one block does not extend from the first side wall to the second side wall and does not open onto the first or second side walls. In an embodiment, the receiving channel of the at least one block opens onto at least one pair of pin holes. In an embodiment, the receiving channel of the at least one block opens onto one pair of pin holes. In an embodiment, the receiving channel of the at least one block opens onto two pairs of pin holes. In an embodiment, the receiving channel of the at least one block opens onto a pair of pin receiving cavities. In an embodiment, the pin receiving cavities of the at least one block have tops and the tops of the pin receiving cavities open onto only the receiving channel. In one embodiment, the pin receiving cavities of the at least one block have tops and the tops of the pin receiving cavities open onto the receiving channel and the top face. In an embodiment, the front face and the back face of the at least one block both have lengths and the length of the front face is greater than the length of the back face. In one embodiment, the at least one block comprises a core.

In an embodiment, the elongate bar has at least two pin receiving slots that receive pins. In one embodiment, the back surface of the elongate bar has a curved shape. In an embodiment, the front surface of the channel bar has a compound angular shape. In one embodiment, the front and back surfaces of the elongate bar are substantially parallel. In an embodiment, the retaining wall further comprises one or more pins in the one or more pin holes.

The invention provides a retaining wall comprising: a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes; a soil retaining material; and a channel bar comprising an elongate bar configured to engage the soil retaining material within the receiving channel, the elongate bar having a generally rectangular base portion having a top surface, a bottom surface, front surface, back surface, and first and second side surfaces, the top and bottom surfaces being substantially parallel, the first and second side surfaces being substantially parallel, the front and back surfaces being substantially parallel, and the bottom surface having at least one channel bar pin extending from the bottom surface. In an embodiment, the bottom surface of the generally rectangular base portion has at least two channel bar pins extending from the bottom surface. In an embodiment, the top surface of the generally rectangular base portion has at least one channel bar pin extending from the top surface. In an embodiment, the top surface of the generally rectangular base portion has at least two channel bar pins extending from the top surface. In an embodiment, the at least one channel bar pin comprises friction fins.

An embodiment of the retaining wall block is shown in FIGS. 1 to 4. Block 100 is made of a rugged, weather resistant material, preferably (and typically) zero-slump molded concrete. Other suitable materials include plastic, reinforced fibers, wood, metal and stone. Block 100 has parallel top face 102 and bottom face 103, front face 104, back face 105 and first and second side walls 106 and 107. Front face 104 and back face 105 each extend from top face 102 to bottom face 103. Side walls 106 and 107 extend from top face 102 to bottom face 103 and from front face 104 to back face 105. Block 100 is generally symmetrical about vertical plane of symmetry S.

Block 100 comprises body portion 108, rear portion 109 and neck portions 110 which connect body portion 108 to rear portion 109. Front face 104 forms part of body portion 108, while back face 105 forms part of rear portion 109. The body, rear and neck portions 108, 109, and 110 each extend between top and bottom faces 102 and 103 and between first and second side walls 106 and 107. Side walls 106 and 107 are thus of a compound shape and have side voids 112 as a result of the reduced width of neck portions 110 compared to that of body and head portions 108 and 109. Side walls 106 and 107 also have side surface 111 which is part of the body 108, and side surface 113 which is part of rear portion 109. The side surface 111 of side 106 and side surface 111 of side wall 107 are angled back towards the back face 105 of the block and can create curvature of a wall when side surface 111 of a block in a course of wall is aligned directly adjacent to side surface 111 of another block in a course of a wall. It should be noted that the shape of the wall being constructed is not limiting and that the placement of the blocks in a course of a wall being constructed may also be linear or any combination of curved and linear as desired.

Opening or core 114 extends through neck portion 110 from top face 102 to bottom face 103. Core 114 is optional and provides the advantage of reducing the weight of block 100. Side voids 112 also reduce the weight of block 100. Lower block weight is both a manufacturing advantage and an advantage when constructing a wall from the blocks as it reduces cost due to less material and makes lifting of the blocks easier.

First and second pin receiving cavities 118 are located in body portion 108 and extend between top and bottom faces 102 and 103, i.e., opening onto both top and bottom surfaces. Pin receiving cavities 118 are referred to as kidney, triangular or slotted shaped, the cavities may be curvilinear, having no sharp angles. The shape and size and location of the cavities are selected to maximize the strength of the block while at the same time, since they extend between the top and bottom surfaces, reducing the weight of the block. Pin receiving cavities 118 preferably extend all the way through the blocks, however, that is not a requirement of the invention and is not limiting as to the scope of the invention. This is an advantage because construction of a wall with the pinning system of the present invention is simplified since the installer can see the pin in a block in a lower course through the pin receiving cavity of a block in an upper course, thus making alignment easier. The weight of the block is also decreased making handling of the blocks easier and less material is used to make the blocks reducing the overall cost of manufacture.

Pin receiving cavities 118 are adjacent a pair of first pin holes 116, i.e., first and second pin holes, which are also located in body portion 108 of the block. The first pair of pin holes 116 are positioned away from pin receiving cavities 118 and slightly set back towards core 114 and towards the line of symmetry S. An optional second pair of pin holes 117, i.e., third and fourth pin holes, is also illustrated in block 100. This optional set of pin holes is located in a rearward direction and further toward the core and away from the line of symmetry S relative to the first set of pin holes and provides a way to offset stacking blocks when constructing a wall, as described further below.

Figure 7A:
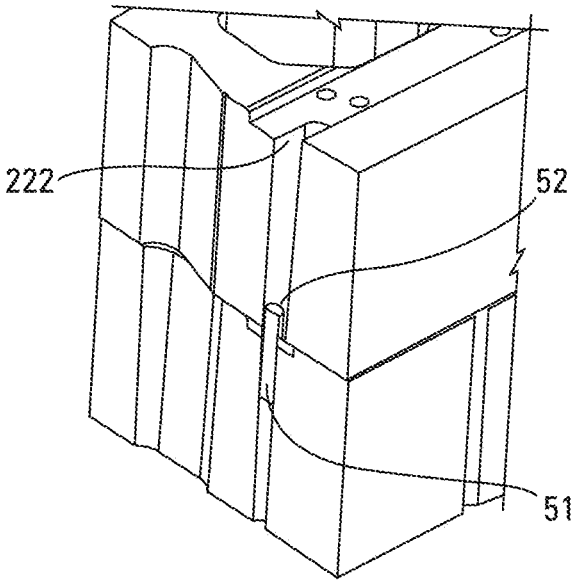
FIGS. 7A and 7B are cross-sectional views of a block and pinning system of the present invention.
Figure 7B:
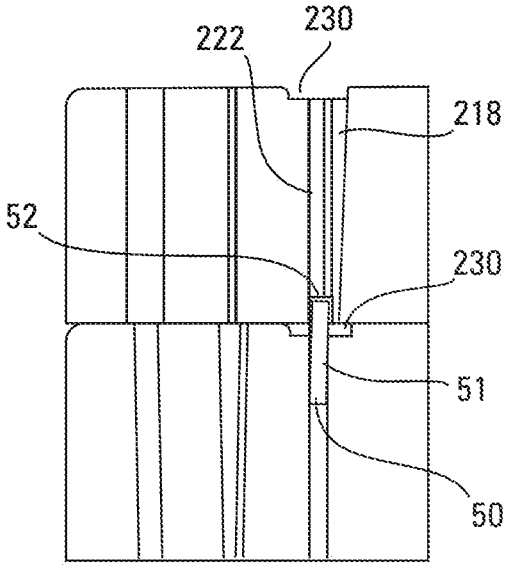

Pin holes typically extend through from the top face 102 to bottom face 103 and are sized to receive pin 50 which is shown in FIGS. 7A and 7B. Pin 50 has a shaft 51 which is placed into a pin hole in the top surface 102 of a lower course of blocks when constructing a wall. Pin 50 may also have a head which projects from the surface of the block of the lower course and abuts to the perpendicular rear wall of the pin receiving cavity of a block in an upper course of a constructed wall. The head (if there is one) of the pin may have a larger diameter than the shaft 51 and may also be tapered, square, round or any other desired shape. Additionally the shaft 51 of the pin may be circular, square or any other desired shape as well. In this manner, the pin in a block on a lower course of blocks in a wall engages a pin receiving cavity of a block in an upper course. This results in an interlocking of the blocks with a predetermined amount of setback or no setback between courses depending upon the location of the pinholes that are utilized in the construction of the wall. It is to be understood that the shape of the pin is not limiting and could be, for example, uniformly shaped with no head or could have any other number of features. Further, although the pin holes are shown as extending through the block from the top surface to the bottom surface the present invention is equally applicable to pin holes that do not extend all the way through the block.

Figure 10:
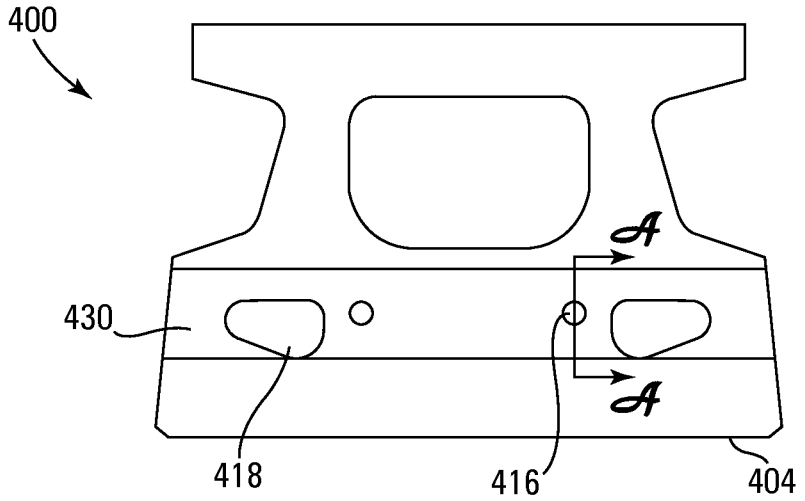
FIG. 10 is a top view of a fourth embodiment of a wall block of the present invention.

Second pin holes 117 are disposed toward the rear or head portion and toward side recesses 112 relative to first pin holes 116. Second pin holes 117 provide increased setback as compared to that provided by first pin holes 116. Further pin holes can be provided, if desired, so as to provide for further choices of predetermined setback. Additionally, the location of the pin holes in the body of the block may be varied as desired as well as the location of the pin receiving cavities. Optionally, only one set of pin holes may be provided as shown in FIG. 10 as desired depending upon the application.

Figure 3:
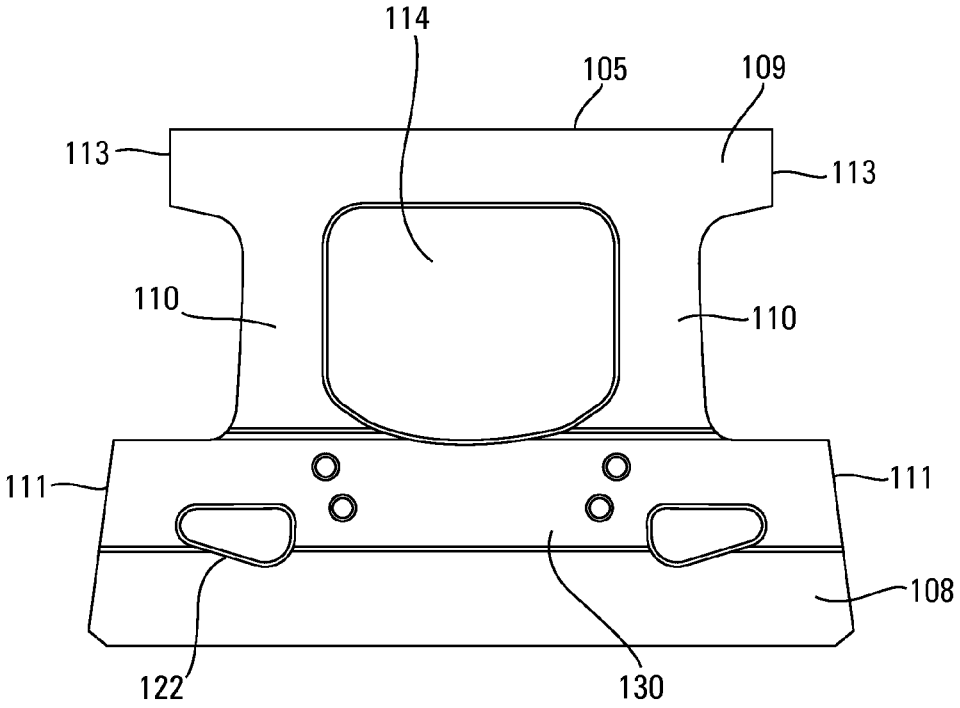
Figure 4:
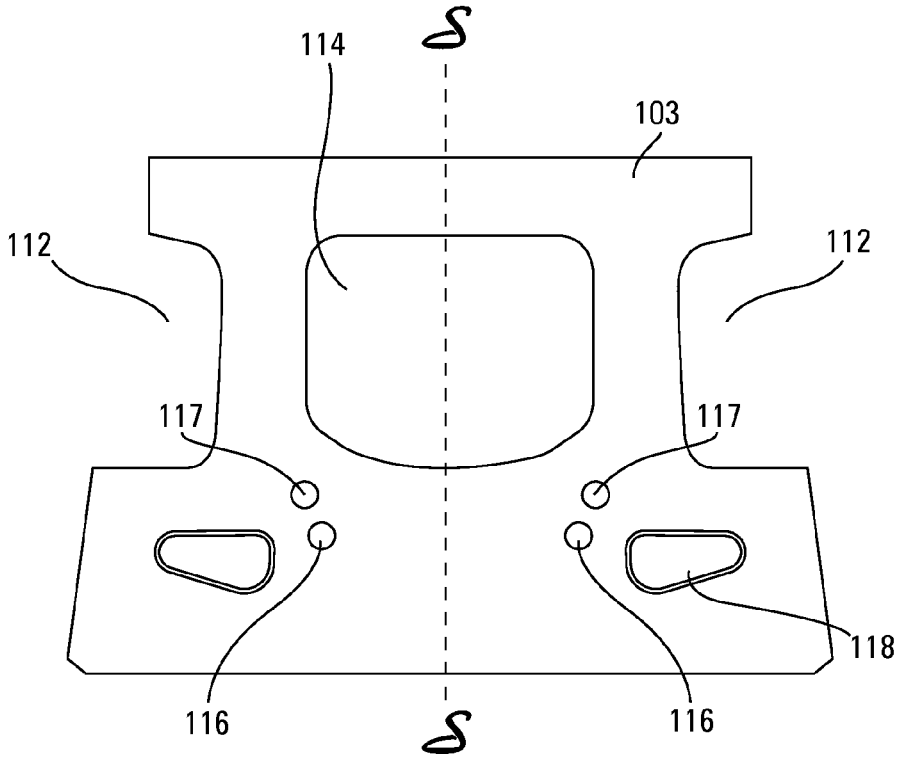
Figure 5:
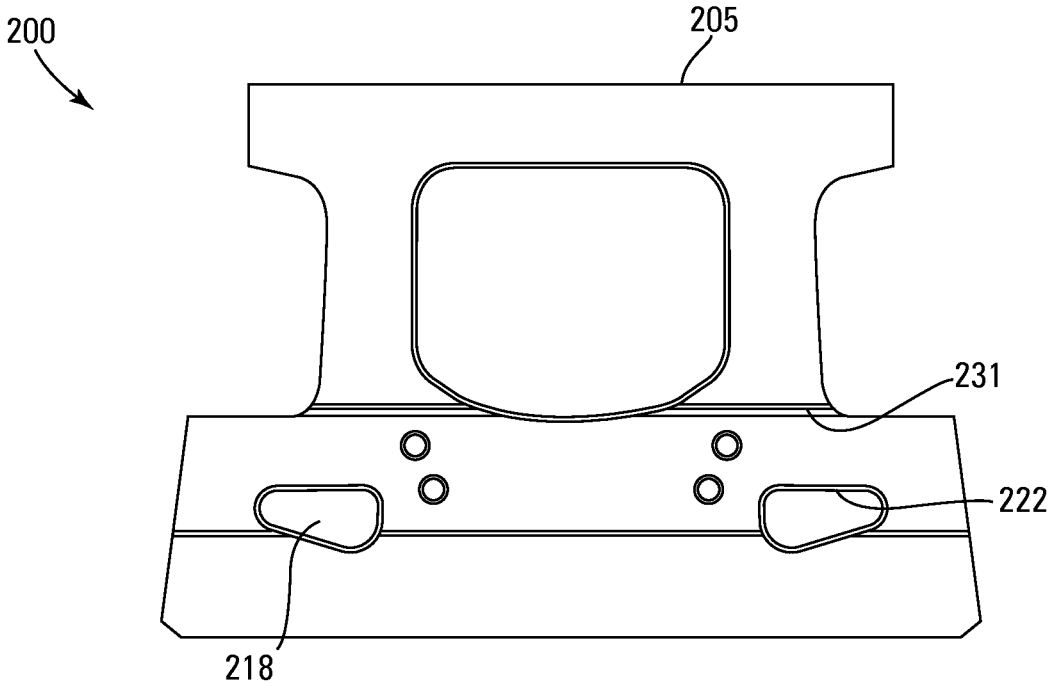
FIGS. 5 and 6 are top and side views, respectively, of a second embodiment of a wall block of the present invention.
Figure 6:
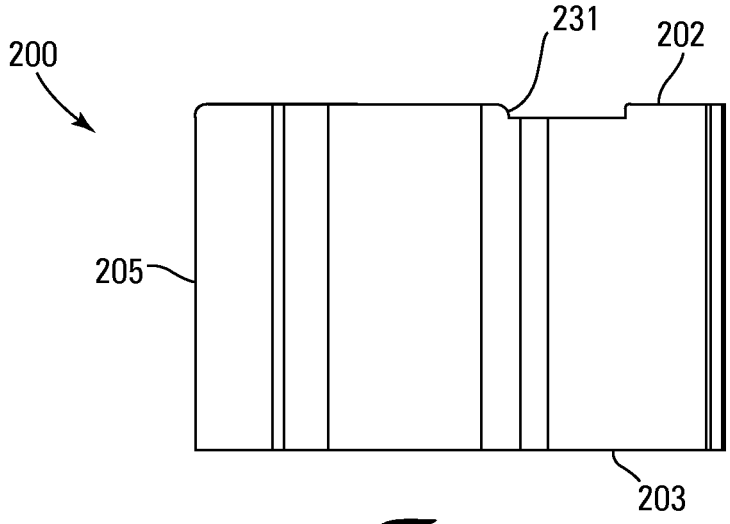
Figure 8:
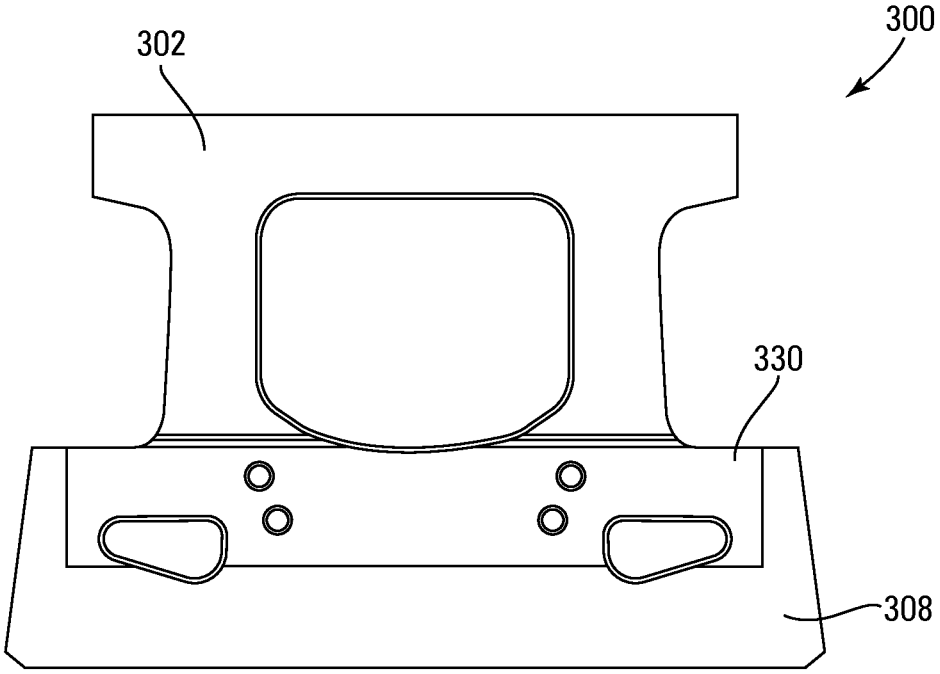
FIGS. 8 and 9 are top and bottom views, respectively, of a third embodiment of a wall block of the present invention.

Top surface 102 has receiving channel 130 located in body portion 108. Receiving channel 130 may extend the entire length of the body portion as shown in FIGS. 1 and 3 and open onto side surfaces 111 of side walls 106 and 107. The channel may also open into the pair of pin receiving cavities 118 and may additionally align on one side with walls 122 of the pin-receiving cavity 118. The channel may also open into the first pair of pin holes 116 and into the second pair of pin holes 117. The receiving channel may be of sufficient width and depth as to accommodate a channel bar and 2 layers of soil retention material (due to fold over) such as geogrid discussed in greater detail below. The receiving channel may specifically have a depth of ¼ of an inch to 1½ (6.4 to 38 mm) inches but may be wider or narrower depending upon the application. It should be noted that the shape, width and length of the channel can vary depending upon the application and could, for example, only encompass one of the sets of pin holes or could completely encompass the pin receiving cavities as shown in FIG. 10. It should further be noted that the length need not span the entire length of body portion 108 and could optionally only open onto one side wall or neither side wall depending upon the application as shown in FIG. 8.

Block 100 is manufactured in the mold with the top surface facing up. A channel mold slat is attached at the top of the mold and imparts the receiving channel 130 into the top surface 102 of the block as the material inside the mold sets around the channel mold slat. The channel mold slat is then removed and the block is stripped from the mold with the receiving channel formed into the top surface of the block.

Though the blocks illustrated in the FIGS. 1 to 4 may have various dimensions, block 100 typically has a height (i.e., the distance between surfaces 102 and 103) of about 8 inches (203 mm), a body length (i.e., the distance from side surface 111 of side wall 106 to side surface 111 of side wall 107) of about 18 inches (457 mm) and a width (i.e., the distance from front face 104 to rear face 105) of about 12 inches (305 mm).

An alternative embodiment of the block is shown in FIGS. 5 to 7B. Block 200 is substantially similar to block 100 except that receiving channel walls 231 or receiving channel 230 and back face 205 have been given a radii or rounded edge. This rounded edge helps to minimize the occurrence of the geogrid ripping or tearing on a sharp angle of the receiving channel wall and back face and thus ensures greater stability and durability of a wall built with such blocks. Additionally, pin receiving cavities 218 each have rear walls 222 that are substantially perpendicular to top surface 202 and bottom surface 203. The remaining wall surfaces of the kidney, triangular or slotted shape of the pin receiving cavities may be tapered for ease of manufacturing. That is, the surface area of the opening of the kidney shape pin receiving cavity at the top surface 202 of the block is slightly greater than the surface area of the opening kidney shape pin receiving cavity in the bottom surface 203 of the block. This taper of some of the surfaces of the pin receiving cavity is used in the manufacturing of the block to strip the pin receiving mold bar used to form the pin receiving cavities from the block in the mold by creating a draft angle which strips the core bar with greater ease from the block in the mold while helping to maintain the integrity of the shape of the pin receiving cavity. Walls 222 of the pin receiving cavity may be designed to remain substantially perpendicular so as to create a more secure abutment for the receiving of the head of a pin 50 inside the pin receiving cavity. FIGS. 7A and 7B illustrate the secured interlocking connection between the two courses. Head 52 of pin 50 abuts wall 222 of the pin receiving cavity causing the pin to shift diagonally in the pin hole of the course of blocks below and thus secures the pin in the pin hole and pin receiving cavity. It should be noted that this is not limiting and that all walls of the pin receiving cavity could all be tapered or perpendicular or any combination thereof depending upon the application.

Figure 9:
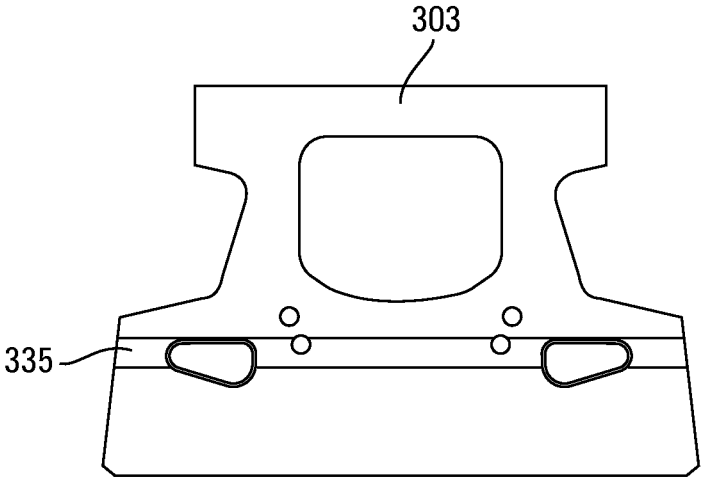

Another embodiment of the block of this invention is illustrated in FIGS. 8 and 9. A top view of block 300 is shown in FIG. 8. Receiving channel 330 has been molded into body portion 308 on top surface 302. Unlike the receiving channel of block 100, receiving channel 330 does not extend and open onto the side walls of block 300 and is completely contained within the body portion 308 of the block. FIG. 9 shows a bottom view of block 300 that has an additional receiving channel 335 on the bottom surface 303 of the block which can receive the head of the pins from a lower course of block at any location inside the channel resulting in greater flexibility of wall design while securing the blocks in one course to the blocks in the next upper course. Receiving channel 335 allows the blocks of an upper course in a wall the option to follow more accurately and with greater ease of installation contour of the blocks from a lower course in a wall especially curved and curvilinear contours by allowing the pins of a lower course of blocks to be received in a broader range of area along the length of the surface of the block. Receiving channel 335 could be incorporated into the block in combination with pin receiving cavities, as shown, or in place of the pin receiving cavities.

Figure 11:
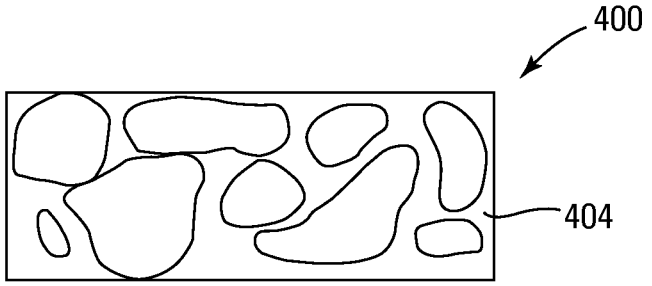
FIGS. 11 and 12 are front views of different embodiments of the wall block of FIG. 10.
Figure 12:
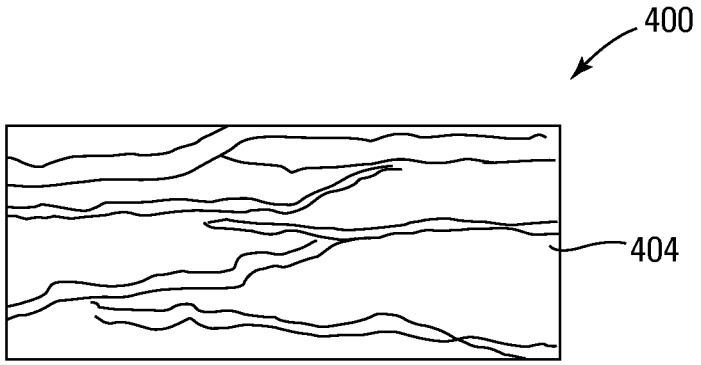

FIG. 10 illustrates an additional embodiment of the block of the present invention. Block 400 is substantially similar to block 100 except that block 400 has only one set of pin holes 416. Additionally, receiving channel 430 is wider than receiving channel 130 and pin receiving cavities 418 are completely contained within the receiving channel 430. FIGS. 11 and 12 illustrate front face 404 of block 400 that has been provided with a desired pattern, design, or texture. These patterns or textures could be applied to the front or back faces of any of the blocks of the present invention. For example, a roughened surface such as the appearance of natural stone is a desirable appearance and can be formed during the molding process with liners as known in the art. It should be noted that the pattern or design is not limiting and any desired pattern could be imprinted onto the block surface as desired.

Figure 13:
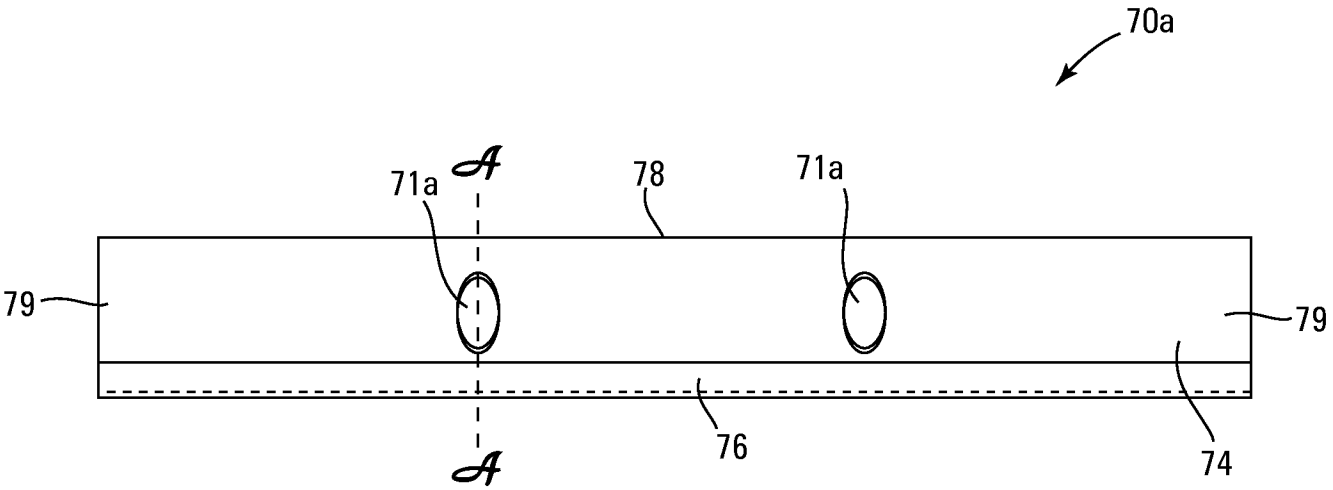
FIGS. 13 and 14 are bottom and cross-sectional side views, respectively, of a channel bar of the present invention.
Figure 14:
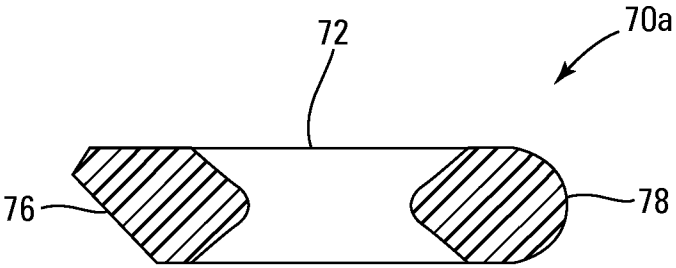

FIGS. 13 to 17 illustrate different embodiments of a channel bar which can be used in combination with the pinning system or separately from the pinning system described above to help secure soil retaining materials such as geogrid to the wall block and thus to the wall itself. FIGS. 13 and 14 show channel bar 70*a* which has a rectangular shape and has pin receiving slots 71*a* that receive pins 50 of the wall block pinning system. Channel bar 70*a* has top surface 72, bottom surface 74, front surface 76, back surface 78 and side surfaces 79. As best seen in FIG. 14, which is a cross-sectional view along line A-A of FIG. 13, back surface 78 has a curved or radial shape and front surface 76 has a compound angular shape. Receiving slots 71*a* have an oval shape and the walls of receiving slots are curvilinear and have a radius that widens from the bottom surface to a halfway point and then narrows to the top surface of the channel bar. It should be noted that the receiving slots can have any number of sizes and shapes depending upon the application. The channel bar is sized in width and length to be accommodated inside the receiving channel of the wall block and can be for example ⅛ to ¼ of an inch (3.2 to 6.4 mm) thick. An advantage of the channel bar having a length substantially similar to the length of the receiving channel of a single block is that the channel bar is easier to carry handle and place when constructing a wall with geogrid from the blocks and channel bar and also allows any wall constructed to have curvature as discussed below. It should be noted that the length, width, and depth of the channel bar is not limiting and the channel bar could have any desired width, length, or depth depending upon the application. The receiving channel can also have any desired width, length, or depth. See FIGS. 23 to 26 for an example of a receiving channel with less depth than the receiving channel shown in FIGS. 18 to 22. For example, the channel bar may be placed into a receiving channel of one block and may be sized to extend into the receiving channel of an adjacent block or blocks. Further the width of the channel bar could be as wide as the receiving channel or narrower as needed depending on the application. The channel bars of the present invention can be made of any suitable material such as mold injected plastics. It should further be noted that the front surface and back surface of the channel bar may have any desired shape or combination of shapes.

Figure 15:
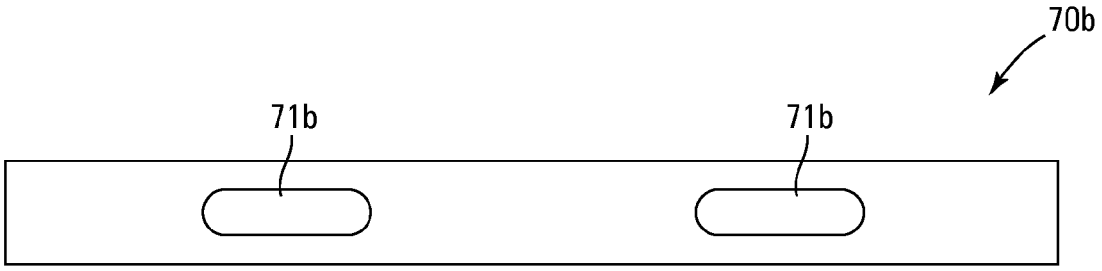
FIG. 15 is a top view.
Figure 36:
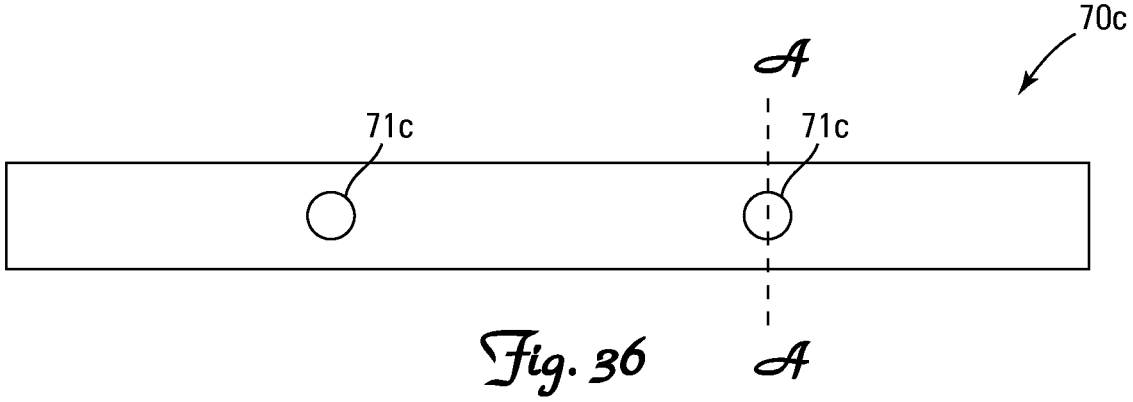
FIG. 36 is a top view.
Figure 38:
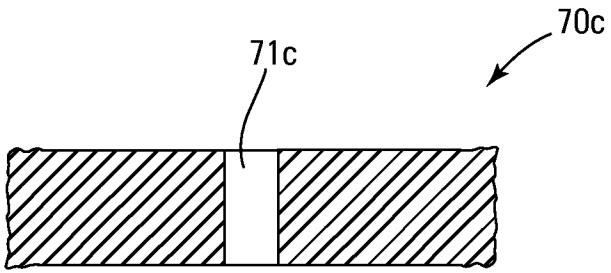
FIGS. 37 and 38 are cross-sectional side views of a channel bar of the present invention.
Figure 37:
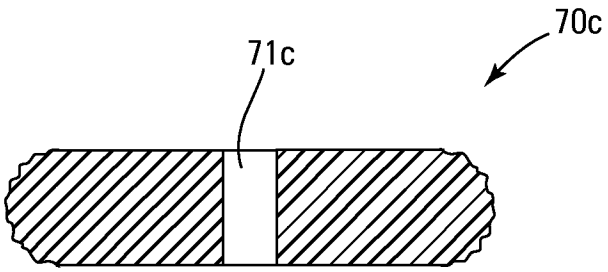

FIG. 15 illustrates channel bar 70*b* which has a rectangular shape and has pin receiving slots 71*b* that receive pins 50 of the wall block pinning system. Unlike channel bar 70*a*, the walls of channel bar 70*b* are perpendicular to its top and bottom surfaces. As shown in FIG. 36, pin receiving slots 71*c* could also be circular in shape and fit the shape of the pins quite closely. As shown in FIGS. 37 and 38, the edges of the channel bar that contact the geogrid could also be roughened or grooved to secure the geogrid better. These edges could be rounded (FIG. 37) or straight (FIG. 38).

Figure 16:
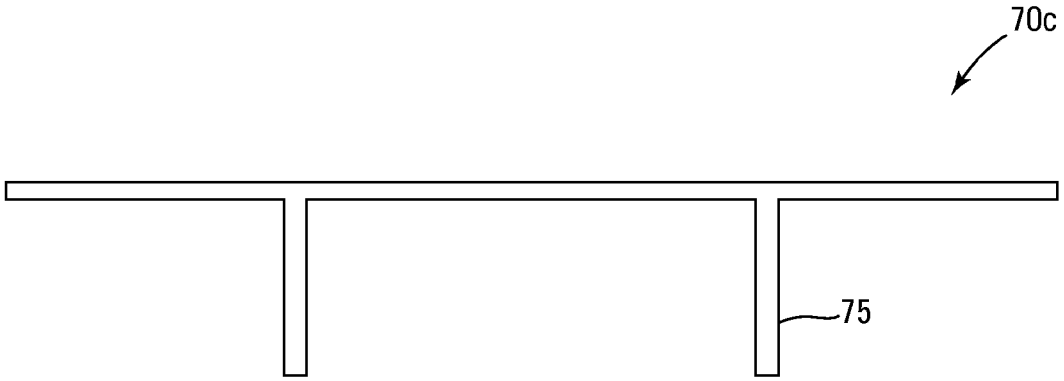
FIGS. 16 and 17 are front views of a second, third and fourth embodiment of a channel bar of the present invention.
Figure 17:
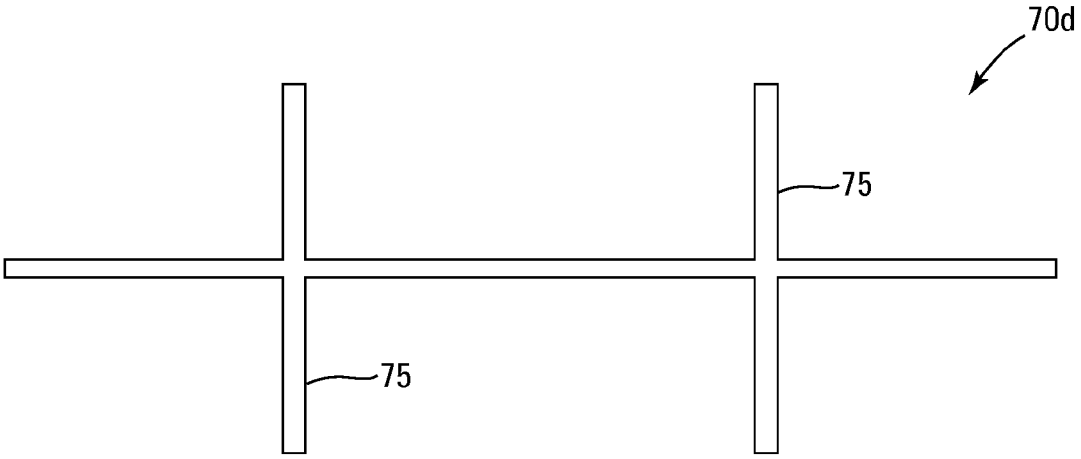

FIG. 16 illustrates channel bar 70*c* which has channel bar pins 75 instead of receiving slots extending from the bottom surface. Channel bar 70*c* eliminates the need for separate pins and combines the pinning system and geogrid securing system into one part. FIG. 17 illustrates channel bar 70*d* which is similar to 70*c* except that channel bar pins 75 extend from both the top and bottom surfaces.

Figure 18:
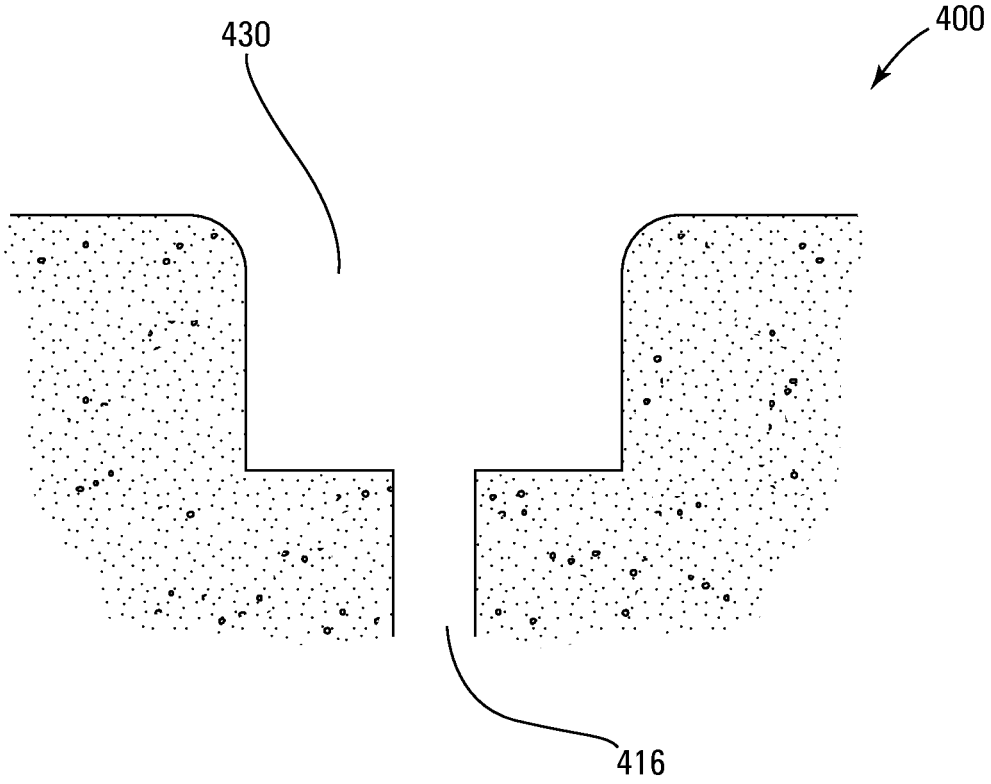
FIGS. 18 to 22 are side cross-sectional views of the block of FIG. 10 with a pinning and channel bar system of the present invention.
Figure 19:
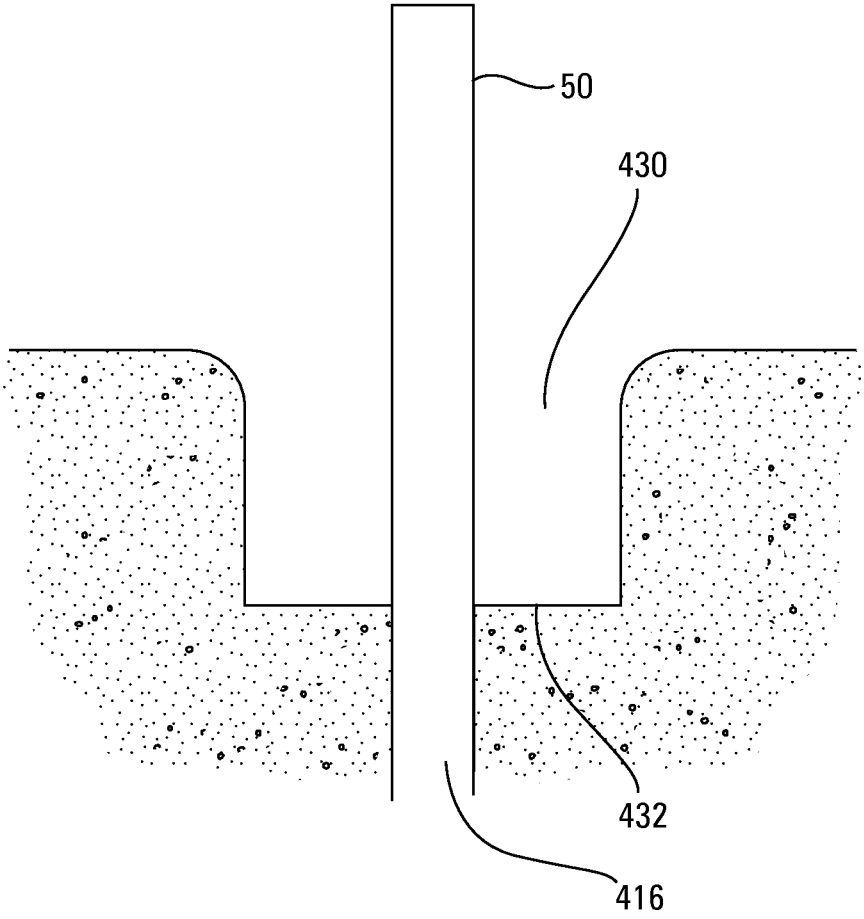

FIGS. 18 to 22 illustrate the method of constructing a structure such as a retaining wall from blocks 400 utilizing pins inserted into pinholes 416 to interlock the blocks and using channel bar 70*a* to secure a geogrid G to the receiving channel 430 to thus stabilize the structure being constructed. In order to illustrate the method by which the wall is constructed FIGS. 18 to 22 show only a small portion of the top surface of a block in the wall including a pinhole 416 and receiving channel 430. FIGS. 18 to 22 show a cross sectional view of the block 400 of FIG. 10 taken along the line A-A. The front face of the block is not shown but is oriented to the right in the drawing figures. The earth or soil which is being retained by the wall is oriented or located to the left in the drawings. Generally, when constructing a wall, a trench is excavated to a pre-selected depth and lined with a level base of granular material such as crushed stone. A base layer is then placed and leveled onto the crushed stone. The blocks are placed side to side with front face 404 facing outward and the bottom surface facing downward. FIG. 18 shows a very enlarged portion of a block 400 in a course of blocks in the wall showing channel 430 and pin hole 416 and where the front of the block is oriented to the right of the drawing and the soil or earth being retained by the wall is oriented to the left of the drawing. Once the base layer is laid additional courses of blocks are placed until the wall reaches a desired height. During construction of the wall, pins 50 are placed into pin holes 416 in the top surface of blocks in a lower course as shown in FIG. 19 and the upper portion of the pins are received in pin receiving cavities 418 in blocks in an adjacent upper course of blocks to connect and stabilize the courses.

Figure 20:
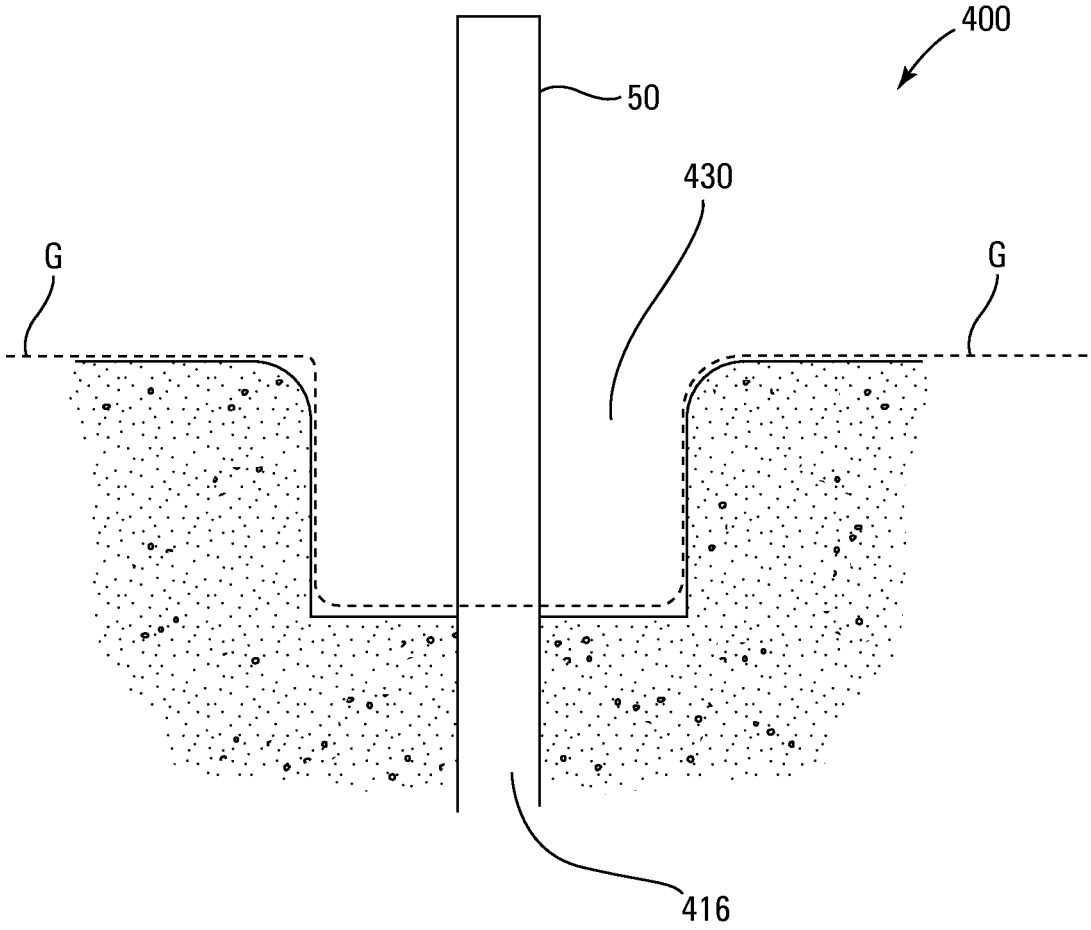
Figure 21:
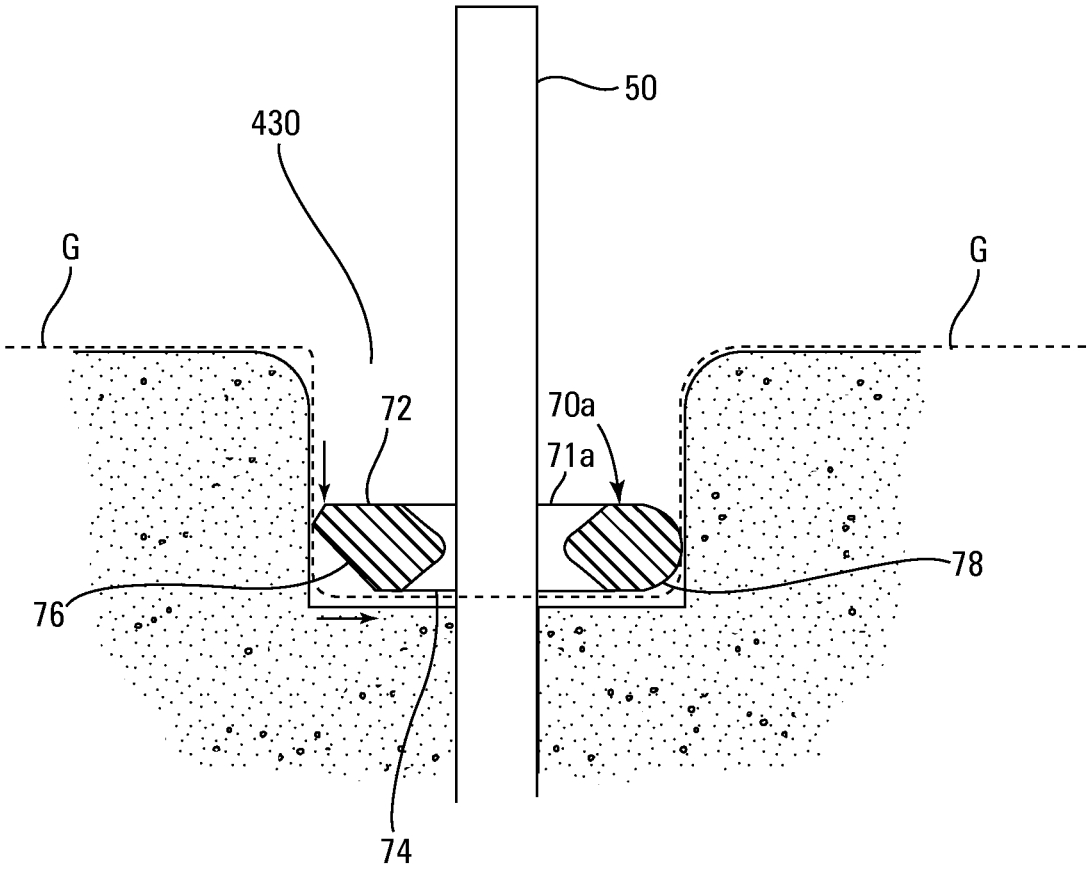

When the wall has reached a height where reinforcement is desired or required a soil retaining material such as a geogrid G may be placed between courses of blocks in the wall. The geogrid G extends outward from the earth behind the retaining wall and is placed onto the wall block and over pins 50 as seen in FIG. 20. Channel bar 70*a* is then placed over the geogrid layer and the pins 50 as shown in FIG. 21. Channel bar 70*a* is placed into receiving channel 430 with top surface 72 facing up and with back surface 78 of channel bar 70*a* facing toward the front face of block 400, thus front surface 76 faces toward the rear portion of block 400.

Figure 22:
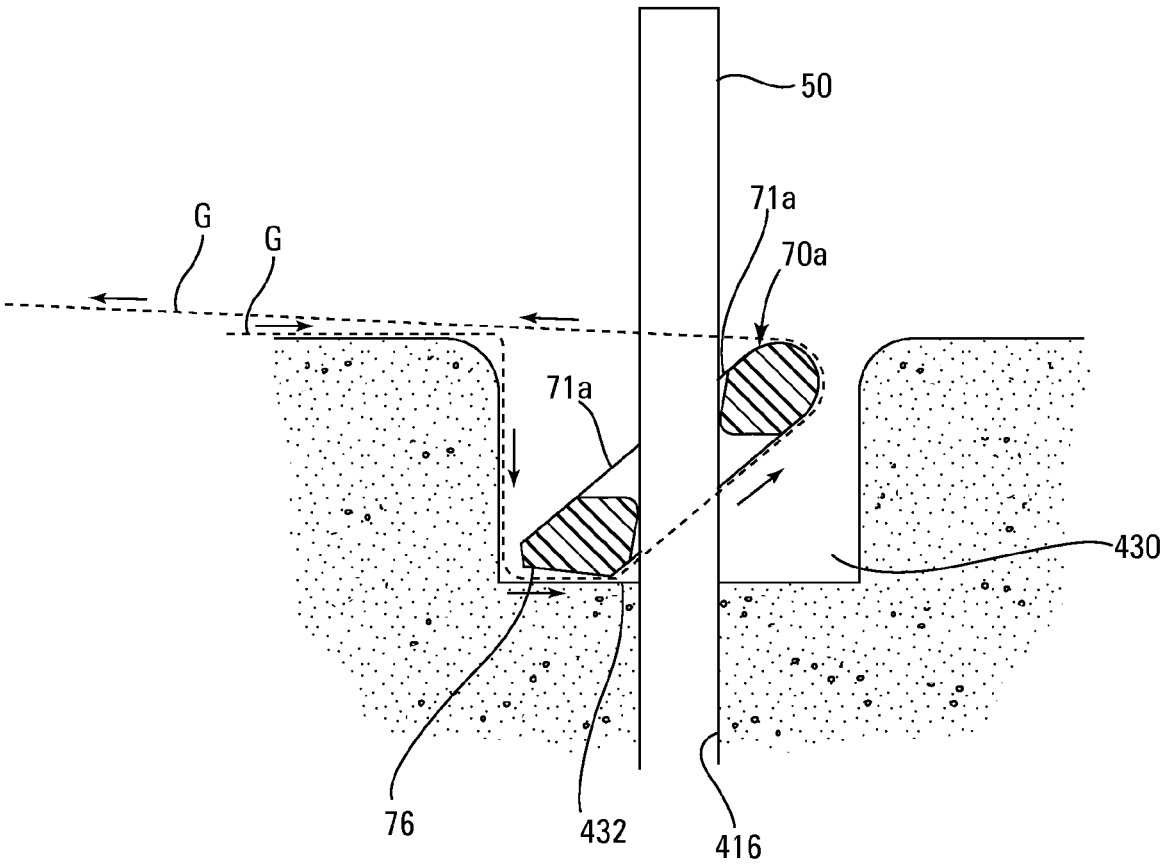

As shown in FIG. 22, the geogrid G that extends outward from the front face of the block and away from the earth that is to be retained is then folded back over or around the channel bar and pins and thus extends back towards the retained earth securing the geogrid to the wall block. As the geogrid G is folded back around and pulled securely over the channel bar

70*a* and pins 50, the tension created causes the channel bar to pivot inside the receiving channel 430 of block 400. As the channel bar pivots the angular front surface 76 of channel bar 70*a* engages bottom surface 432 of the receiving cavity 430 and the tapered pin receiving slots 71*a* engage the surface of pin 50 thereby locking or fixedly securing the channel bar 70*a* inside the receiving channel 430 of block 400. If a channel bar of FIG. 15 or 36 is used, the channel bar would have much less of a pivot as the geogrid G is put in tension. The tension of the geogrid causing the securing of the channel bar in the receiving channel is continuously maintained due to the retaining forces of the geogrid. The manufactured shape of the channel bar and receiving slots of the channel bar allow for the geogrid to be fixedly secured in the receiving channel of the block and thereby to the retaining wall adding to the overall structural integrity of the wall being constructed. The next layer of blocks is placed on top of this course with the pin receiving cavities in the lower surfaces of the blocks accepting the pin in the block of the lower course which helps to additionally lock and secure the geogrid and thus the channel bar in the receiving channel. This continues for all subsequent layers of the wall until the desired height of the wall is reached. It should be noted that the receiving channel for the geogrid could be secured to the bottom side of the block by flipping the block of the present invention over so that the top surface of the block becomes the bottom surface of the block in the construction of the wall and thus the geogrid is secured to the bottom surface of the block depending upon the application.

Figure 23:
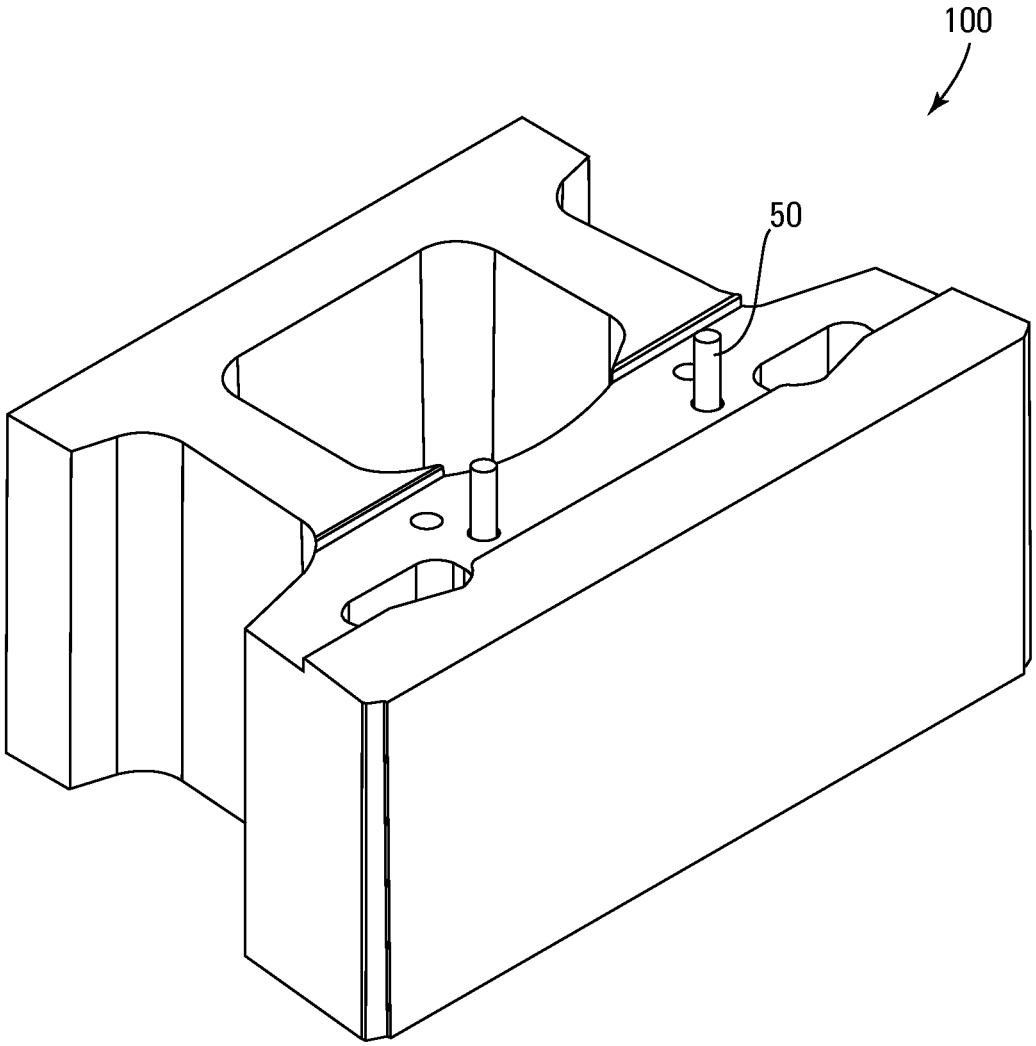
FIGS. 23 to 27 are perspective views of the block of FIGS. 1 to 4 with a pinning and channel bar system of the present invention.

FIGS. 23 to 27 illustrate the method of constructing a structure such as a retaining wall from blocks 100 utilizing pins inserted into pinholes 116 to interlock the blocks and channel bar 70*b* to secure a geogrid G to the receiving channel 130 and thus the structure being constructed. The blocks are placed side to side with front face 104 facing outward and the bottom surface facing downward. Once the base layer is laid, pins 50 are placed into pin holes 116 as shown in FIG. 23 and additional courses of blocks are placed in a manner similar to that described above until a desired height is reached.

Figure 24:
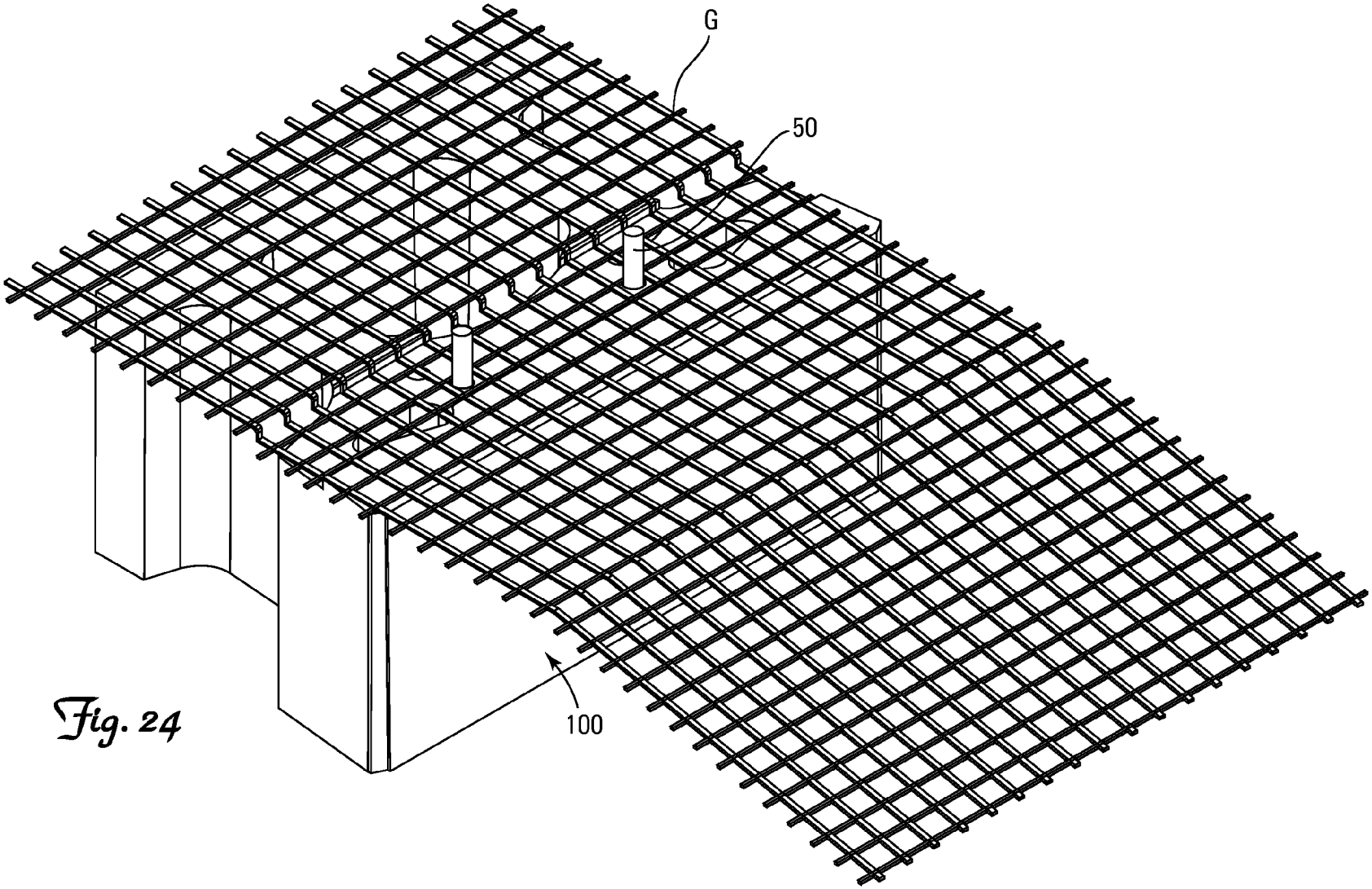
Figure 25:
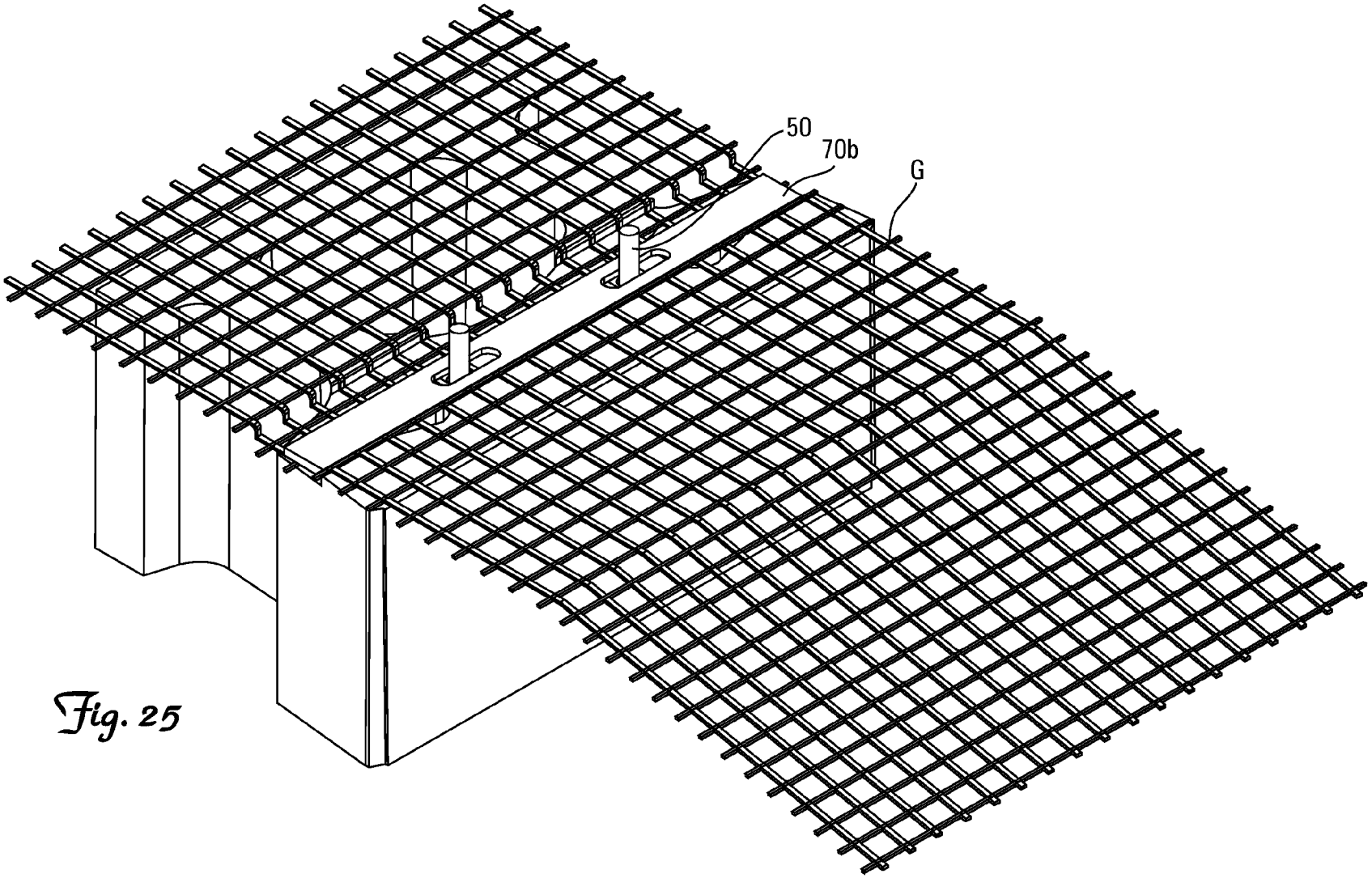
Figure 26:
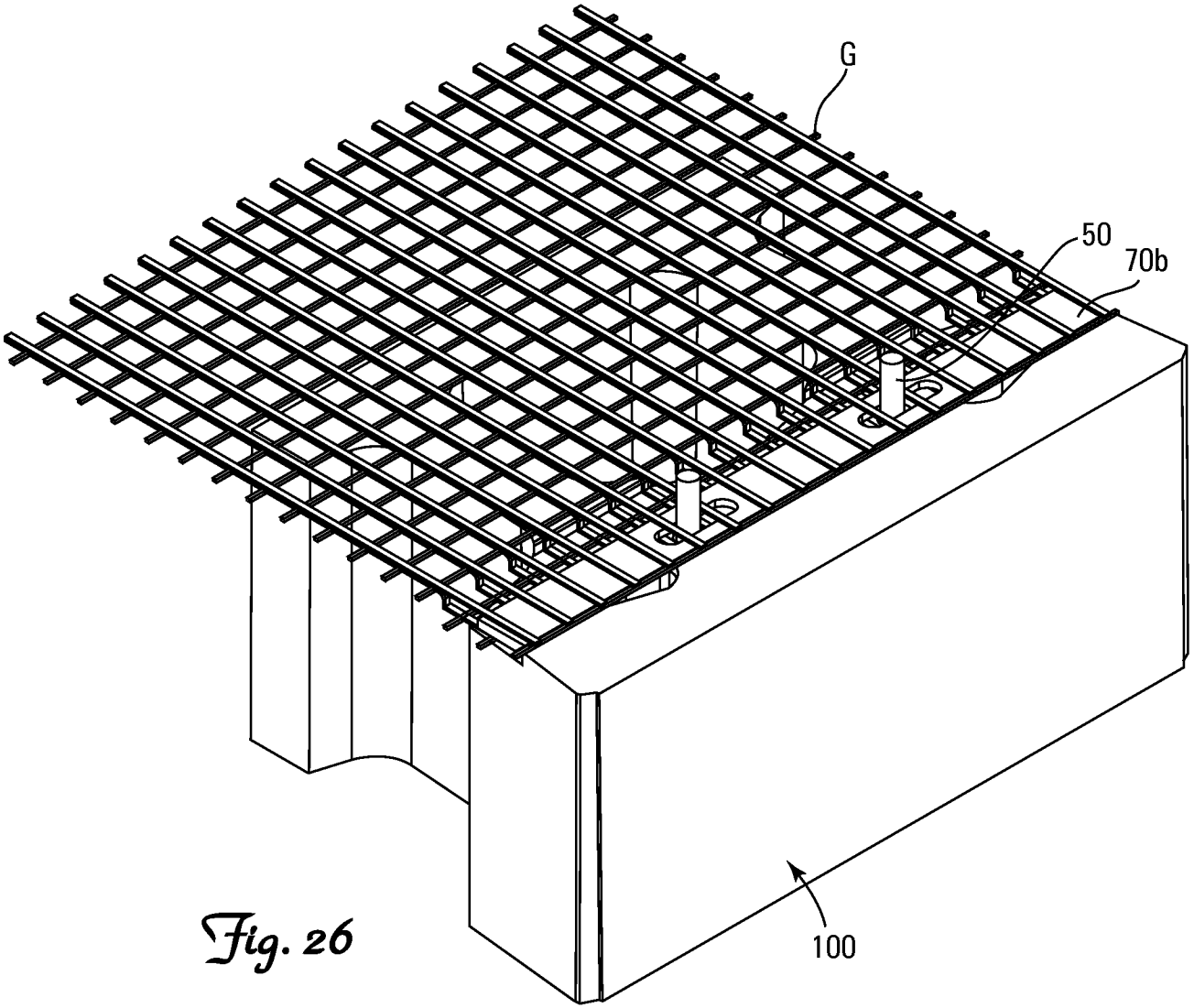
Figure 27:
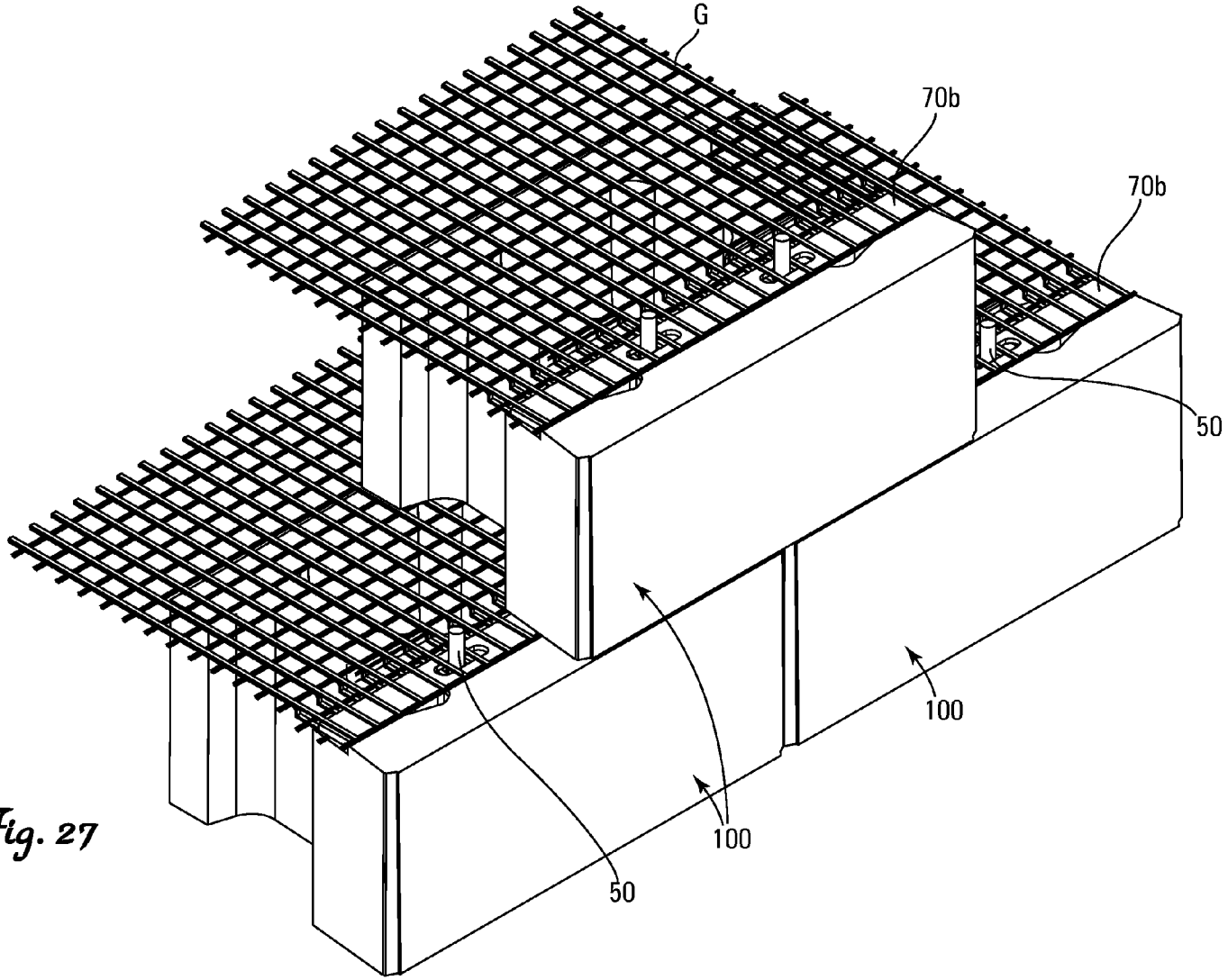

Once the wall has reached a height where reinforcement or stabilization is desired or necessary a soil retaining material such as a geogrid G may be used. Geogrid G extends outward from the earth behind the retaining wall and is placed onto the wall block and over pins 50 as shown in FIG. 24. Channel bar 70*b* is then placed over the geogrid layer and over pins 50 as shown in FIG. 25. The geogrid G is then folded back and pulled securely over the channel bar 70*b* and pins 50 as shown in FIG. 26. The next layer of blocks is placed on top of the base course with the pin receiving cavities in the bottom surface of blocks in the next layer accepting the upper portion of pins in the blocks of the lower course which helps to additionally lock and secure the geogrid and thus the channel bar in the receiving channel. See FIG. 27. Construction of the wall is continued until the desired height is reached. One or more additional layers of geogrid may be included as desired or necessary to maintain the stability and safety of the wall.

Figure 28:
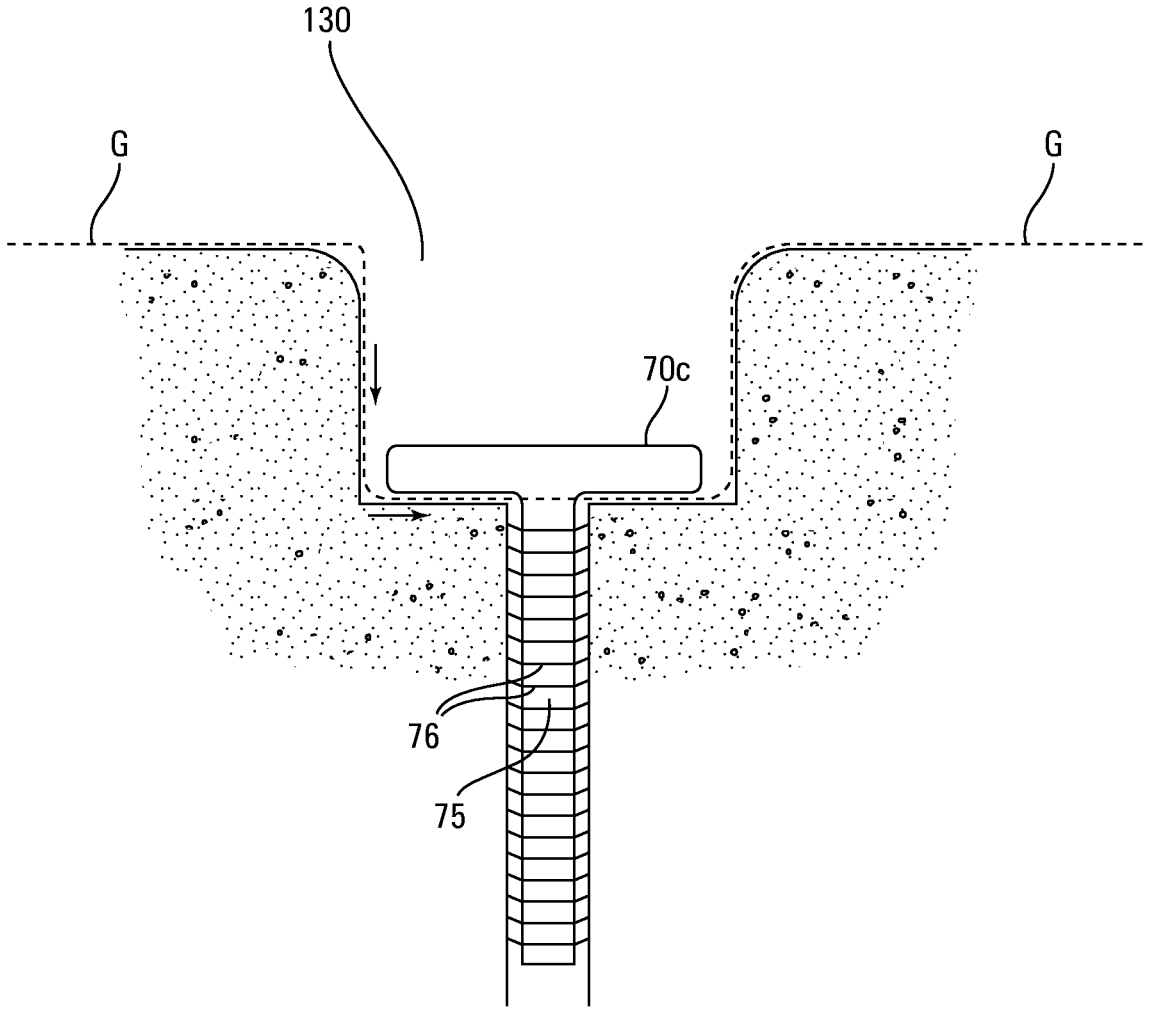
FIGS. 28 to 30 are side cross-sectional views of the block of FIGS. 1 to 4 with differing channel bar systems of the present invention.
Figure 29:
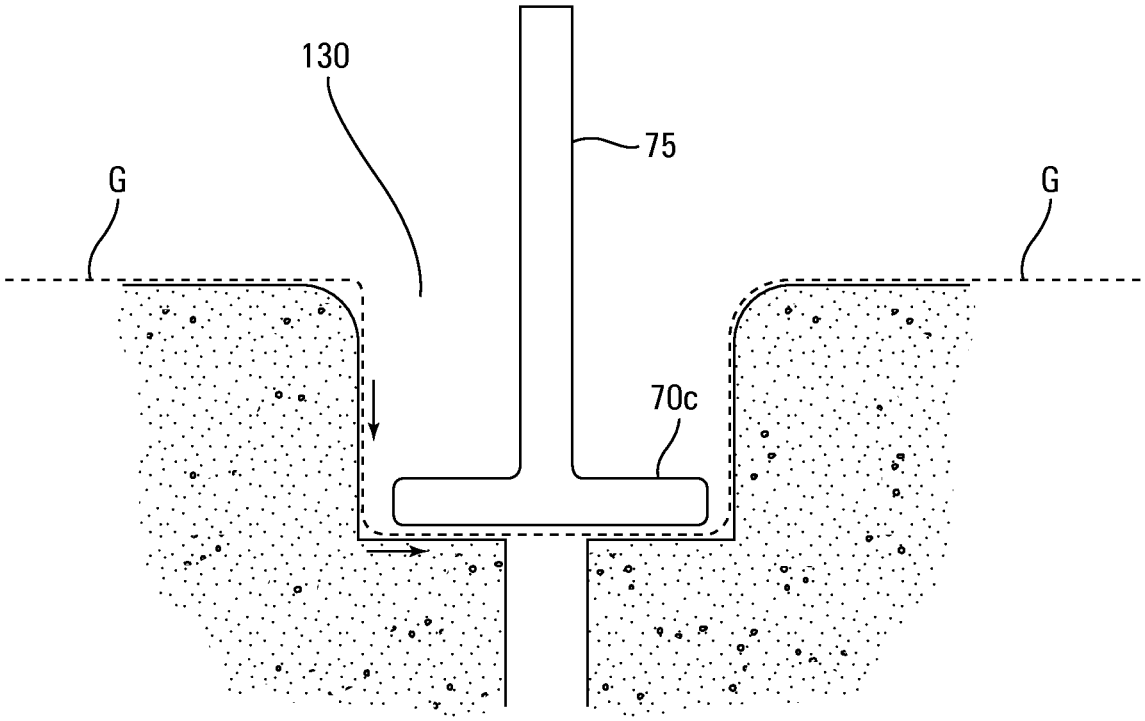
Figure 30:
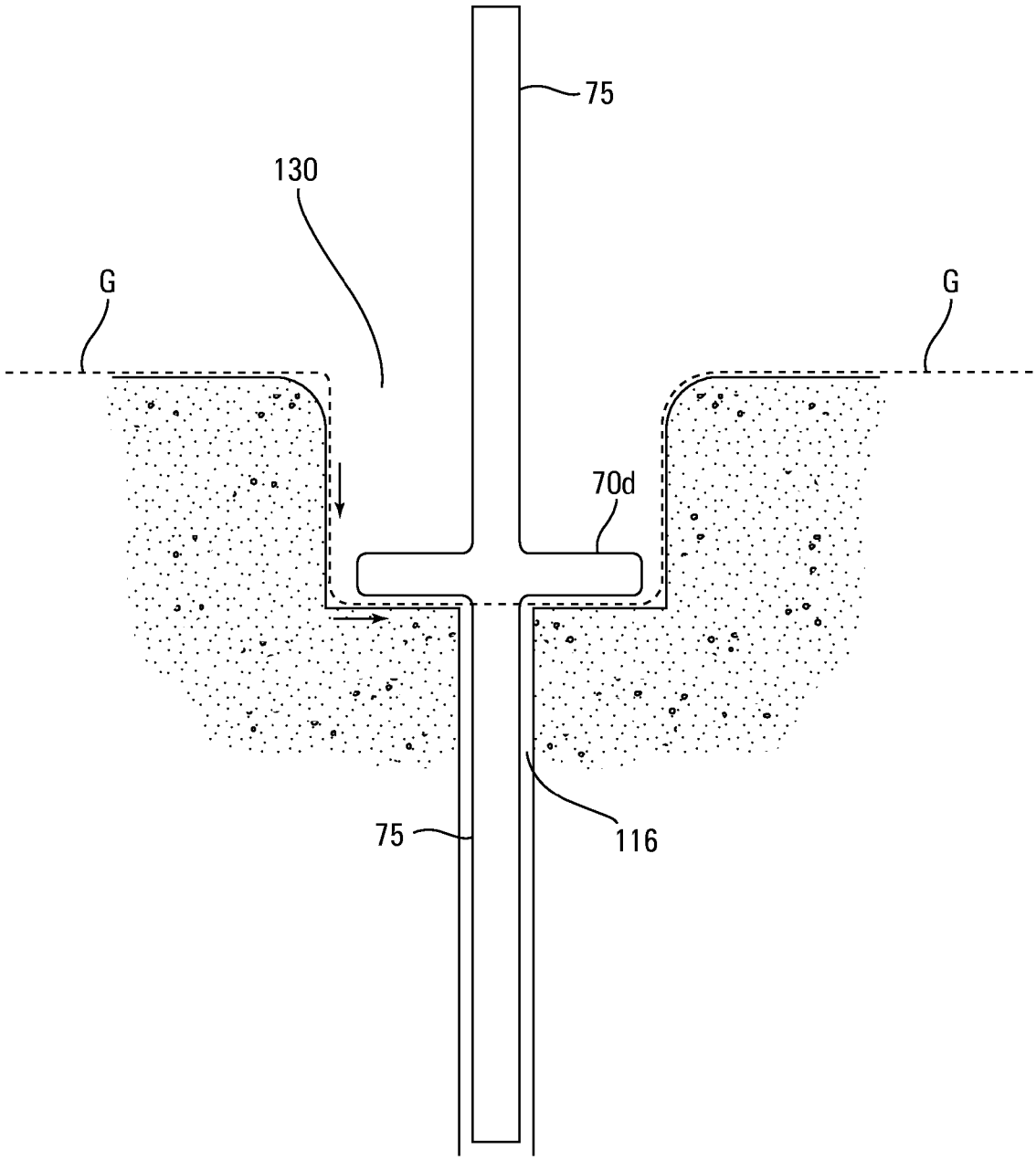

FIGS. 28 to 30 illustrate different ways in which the channel bars of FIGS. 16 and 17 of the present invention could be utilized to attach geogrid to walls instead of using pins 50. FIG. 28 shows channel bar pins 75 of channel bar 70*c* oriented in a downward direction and being inserted through geogrid G and into pin holes 116 of receiving channel 130 with the geogrid G then being readied to be pulled back over channel bar 70*c*. The channel bar pins in this embodiment have been provided with friction fins 76 for additional securing of channel bar 70*c* and thus the geogrid to the block. It should be noted that any of the embodiments of the pins or channel bar pins of the present invention may be provided with the friction fins depending upon the application. FIG. 29 shows channel bar 70*c* with pins 75 oriented in an upward direction and being inserted onto a layer of geogrid G into receiving channel 130 with the geogrid G then being readied to be pulled back over channel bar 70*c* and over channel bar pins 75. After the geogrid has been pulled back over channel bar 70*c*, channel bar pins 75 are received in the pin receiving cavities of an upper course of blocks. FIG. 30 shows geogrid G extending from the earth behind the retaining wall and placed into the receiving channel 130 of a block. The channel bar pins 75 of the bottom surface of channel bar 70*d* are then threaded through the geogrid and into the pin holes 116 of the lower course of block. The geogrid is then folded back and wrapped around channel bar 70*d* and over the channel bar pins 75 extending from the top surface of the channel bar 70*d*. The upper layer of blocks are placed on top of the lower course with the pin receiving cavities accepting the channel bar pin 75 of the top surface of channel bar 70*d*.

Figure 31:
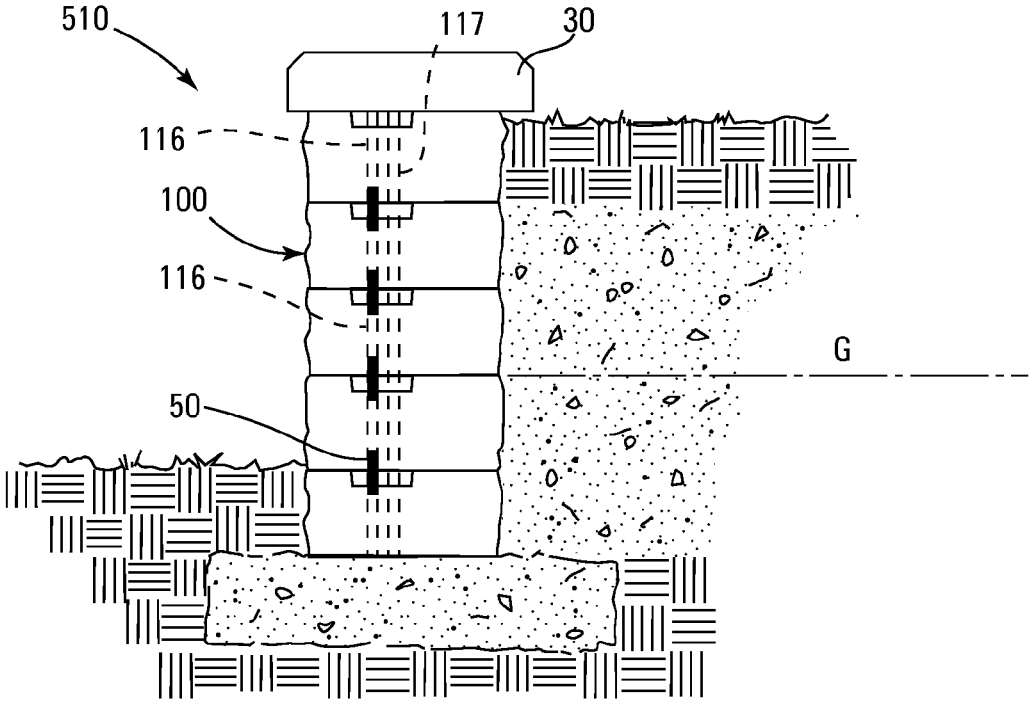
FIGS. 31 and 32 illustrate straight vertical retaining wall and a straight set-back retaining wall, respectively of the present invention.
Figure 32:
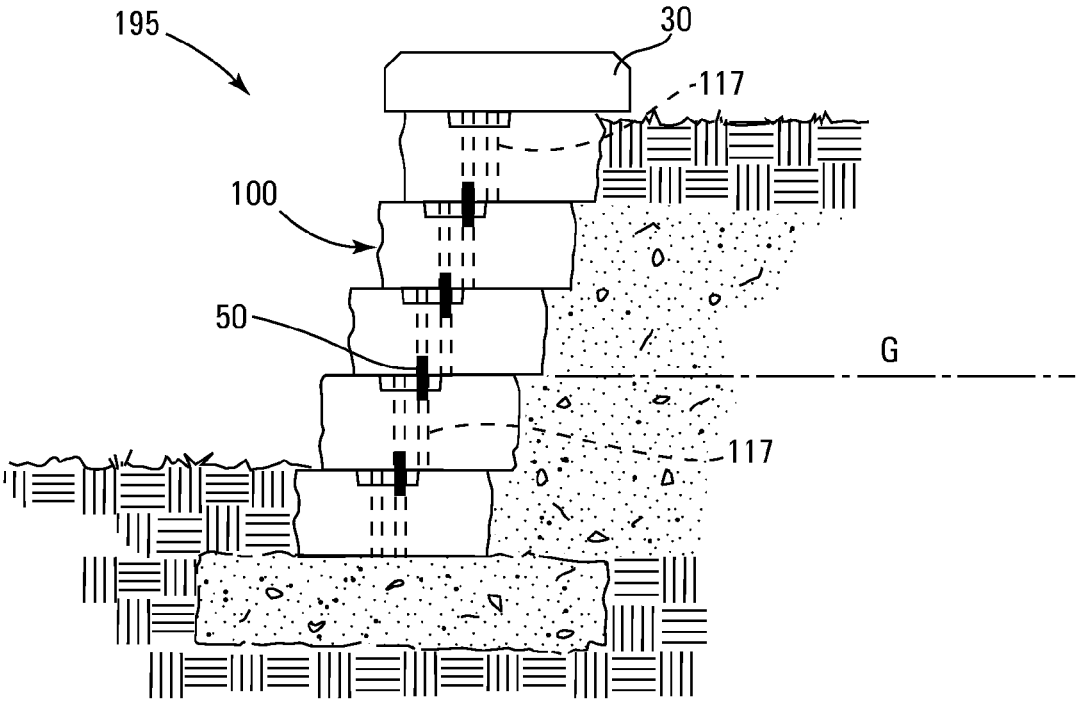

Once the desired height of the wall is reached a capping layer may be added. Typically, the placement of blocks is vertically offset in adjacent courses in a running bond pattern. FIG. 31 illustrates a wall constructed with first pair of pin holes 116 of block 100 being utilized with pins 50. Pin holes 116 provides near vertical setback between courses resulting in a vertical wall 510. FIG. 32 illustrates a straight retaining wall 195 constructed from blocks 100 utilizing the second pair of pinholes 117 to interlock the blocks. As can be seen, use of the second pair of pin holes 117 with pin 50, provides for setback between courses resulting in stepped back wall 195. It should be noted that the receiving channel of the block is wide enough to encompass the width of the channel bar to be used to secure the geogrid to the block with the use of the first or second set of pin holes.

Figure 33:
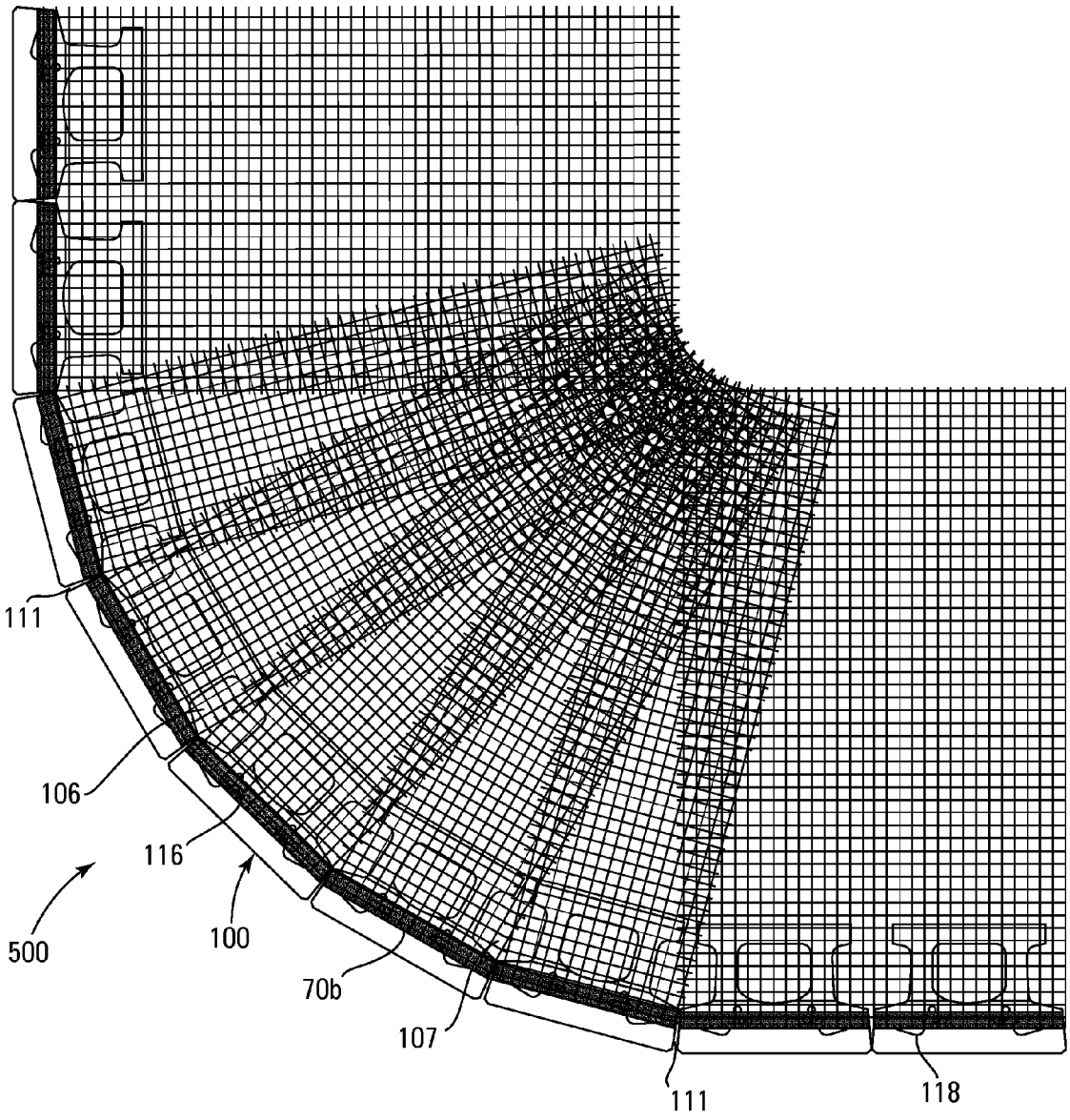
FIGS. 33 to 35 are top, back perspective and front perspective views of a curved vertical retaining wall of the present invention.
Figure 34:
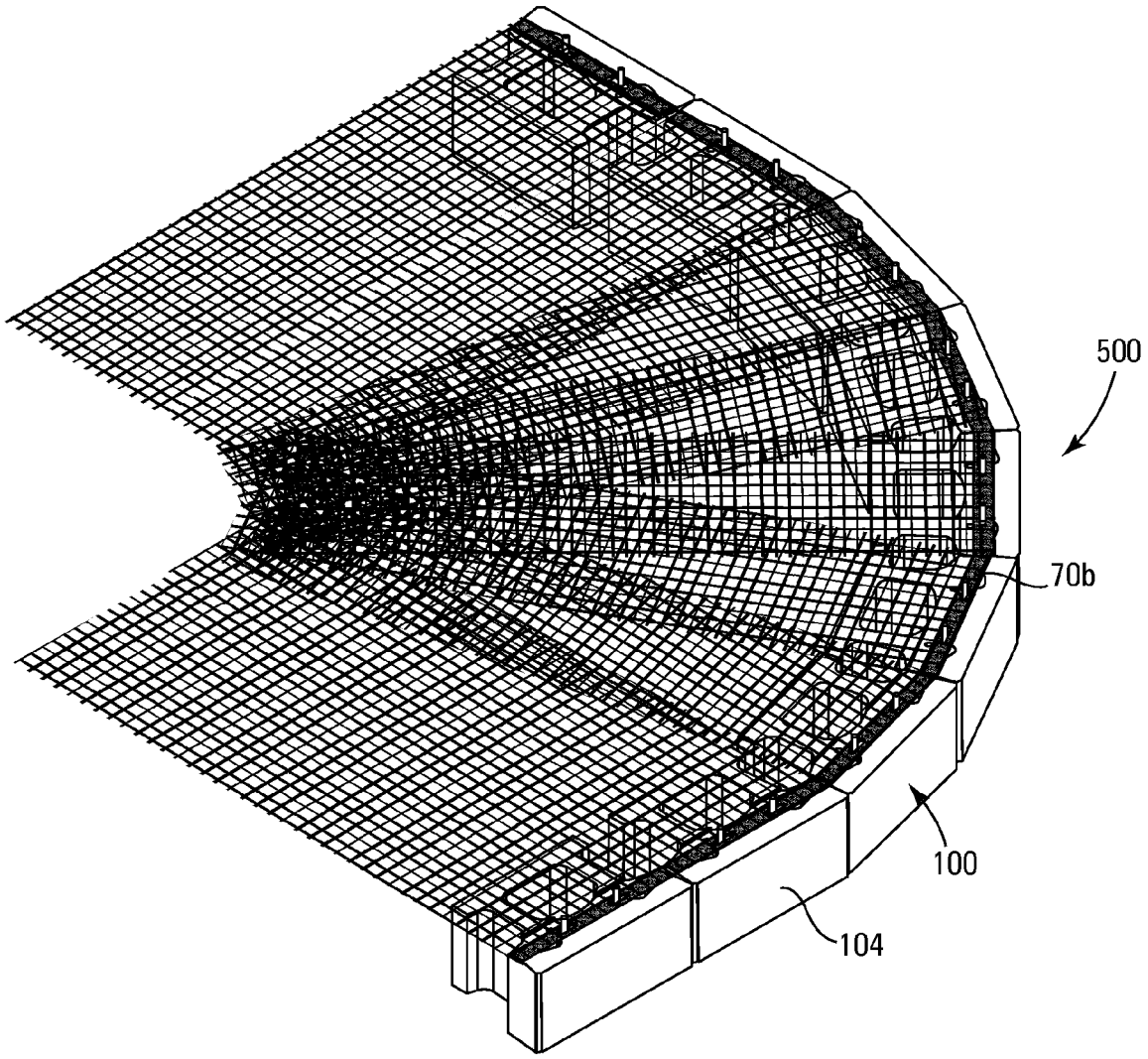
Figure 35:
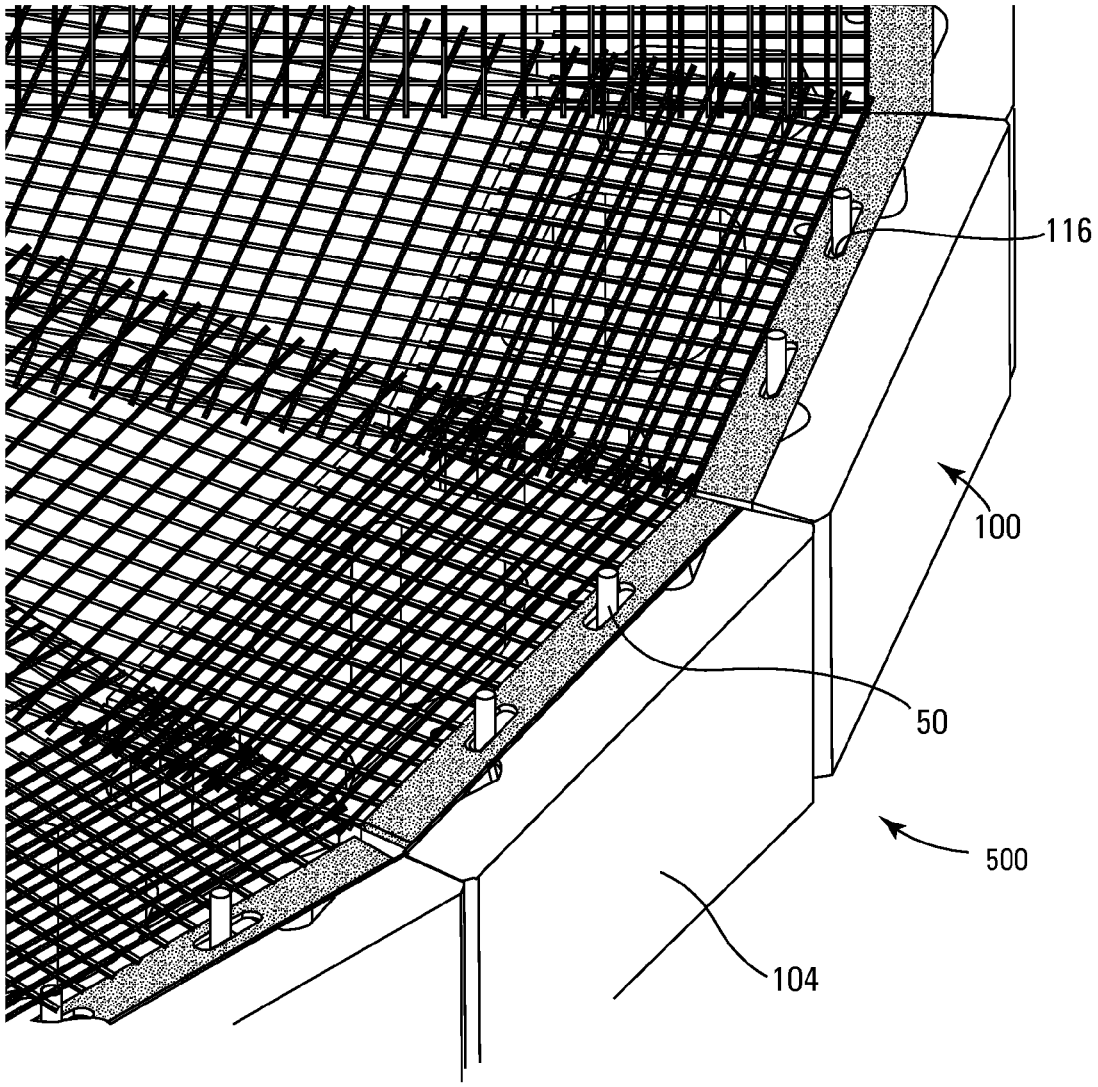

FIGS. 33 to 35 illustrate curved retaining wall 500 constructed from blocks 100 utilizing the first pair of pinholes 116 to interlock the blocks. A trench is excavated to a preselected depth and lined with a level base of granular material such as crushed stone. A base layer is then placed and leveled onto the crushed stone. The blocks are placed side to side with angled side surface 111 of side 106 adjacent with the angled side surface 111 of side wall 107 of an adjacent block in the course of wall. The amount of curvature can vary depending upon how closely the angled side surfaces are from each other. Front face 104 is placed facing outward and bottom surface 103 facing downward. It should be noted that the bottom surface 103 should be placed facing downward so that pin receiving cavities 118 can receive the heads of the pins from the previous course of blocks. Once the base layer is laid, pins are placed into pin holes 116. A soil retaining material such as a geogrid extends from the earth behind the retaining wall and is placed onto the wall block between course of blocks at a height where stabilization of the wall is desired or necessary. The geogrid is placed over pins 50 and the width of the strip of geogrid material being used may be substantially similar to that of the width of the block along the curvature for greater ease when constructing the wall. It should be noted that this is not limiting and that any width strip of geogrid material may be used. One of the channel bars 70*a* or 70*b* is then placed over the geogrid layer and over pins 50. The geogrid that extends outward from the front face of the block and away from the earth that is to be retained is then folded back over the channel bar and the pins and thus extends back towards the retained earth securing the geogrid to the wall block. The length of geogrid that is folded back over the top of the channel bar is preferably significantly longer then the length of the lower layer of geogrid. See FIGS. 24, 25, and 35. The next layer of blocks is placed on top of the base course with the pin receiving cavities 118 accepting the head 52 of the pin. This continues for all subsequent layers of the wall until the desired height of the wall is reached. As can be seen, use of first pair of pin holes 116 with pin 50 in a lower course of blocks in a wall projecting into pin receiving cavities 118 of an upper course of blocks, provides near vertical setback between courses resulting in a near vertical wall.

Bottom surface 103 could be modified to include a pin receiving channel similar to pin receiving channel 335 of block 300 so that the pin receiving channel can receive the heads of the pins from the previous course of blocks. The pin receiving channel produces greater flexibility for the curve of the wall by allowing the head of the pin to be received at any position along the length of the body of the block. This flexibility allowed by the pin receiving channel results in the maintainability of the curve through each successive course of blocks of the wall and facilitates the ability to interlock blocks in successive course thus giving the wall more structural stability and strength. It should be noted that a pin receiving channel could be placed in many different block shapes and types and that different types of walls, such as freestanding, may be made using this system to create a curved, circular or serpentine shaped wall depending upon the application.

Although particular embodiments have been disclosed herein in detail, this has been done for purposes of illustration only, and is not intended to be limiting with respect to the scope of the appended claims, which follow. In particular, it is contemplated that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A retaining wall comprising:

a plurality of blocks including at least one lower course and at least one upper course, at least one block comprising a block body having opposed front and back faces, opposed first and second side walls, and opposed and substantially parallel top and bottom faces, the top face having a receiving channel, and the receiving channel opening onto one or more pin holes;

a geogrid;

one or more pins in the one or more pin holes; and a channel bar comprising an elongate bar configured to engage the geogrid within the receiving channel, the elongate bar being generally rectangular and having a top surface, a bottom surface, front surface, back surface, and first and second side surfaces, the top and bottom surfaces being substantially parallel, the first and second side surfaces being substantially parallel, and the elongate bar having at least one pin receiving slot that receives pins, wherein the elongate bar is positioned within the receiving channel of said at least one block and over a first portion of the geogrid.

2. The retaining wall of claim 1, wherein the front face of the at least one block is substantially parallel to the back face.

3. The retaining wall of claim 1, wherein the receiving channel of the at least one block is substantially parallel to the front face.

4. The retaining wall of claim 1, wherein the receiving channel of the at least one block is substantially perpendicular to a vertical plane of symmetry.

5. The retaining wall of claim 1, wherein the receiving channel of the at least one block is closer to the front face than the back face.

6. The retaining wall of claim 4, wherein the receiving channel of the at least one block extends from the first side wall to the second side wall and opens onto the first and second side walls.

7. The retaining wall of claim 4, wherein the receiving channel of the at least one block does not extend from the first side wall to the second side wall and does not open onto the first or second side walls.

8. The retaining wall of claim 1, wherein the receiving channel of the at least one block opens onto at least one pair of pin holes.

9. The retaining wall of claim 1, wherein the receiving channel of the at least one block opens onto one pair of pin holes.

10. The retaining wall of claim 1, wherein the receiving channel of the at least one block opens onto two pairs of pin holes.

11. The retaining wall of claim 1, wherein the receiving channel of the at least one block opens onto a pair of pin receiving cavities.

12. The retaining wall of claim 11, wherein the pin receiving cavities of the at least one block have tops and the tops of the pin receiving cavities open onto only the receiving channel.

13. The retaining wall of claim 11, wherein the pin receiving cavities of the at least one block have tops and the tops of the pin receiving cavities open onto the receiving channel and the top face.

14. The retaining wall of claim 1, wherein the front face and the back face of the at least one block both have lengths and the length of the front face is greater than the length of the back face.

15. The retaining wall of claim 1, wherein the at least one block comprises a core.

16. The retaining wall of claim 1, wherein the elongate bar has at least two pin receiving slots that receive pins.

17. The retaining wall of claim 1, wherein the back surface of the elongate bar has a curved shape.

18. The retaining wall of claim 1, wherein the front surface of the channel bar has a compound angular shape.

19. The retaining wall of claim 1, wherein the front and back surfaces of the elongate bar are substantially parallel.

20. The retaining wall of claim 1, wherein a second portion of the geogrid is folded back over the top surface of the elongate bar.

21. The retaining wall of claim 20, wherein the geogrid includes a third portion having a first length that is the length from a line where the geogrid is folded over to its first end line in the earth that is to be retained, the third portion of the geogrid including the second portion of the geogrid, the geogrid including a fourth portion having a second length that is the length from the line where the geogrid is folded over to its second end line, the fourth portion of the geogrid including the first portion of the geogrid, the third portion of the geogrid being above the fourth portion of the geogrid, and the first length being greater than the second length.

* * * * *